US010693239B2

(12) United States Patent
Ross, III et al.

(10) Patent No.: US 10,693,239 B2
(45) **Date of Patent: *Jun. 23, 2020**

(54) HDTV ANTENNA ASSEMBLIES

(71) Applicant: Antennas Direct, Inc., Ellisville, MO (US)

(72) Inventors: John Edwin Ross, III, Moab, UT (US); Richard E. Schneider, Wildwood, MO (US)

(73) Assignee: Antennas Direct, Inc., Ellisville, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/184,594

(22) Filed: Nov. 8, 2018

(65) Prior Publication Data

US 2019/0081401 A1 Mar. 14, 2019

Related U.S. Application Data

(63) Continuation of application No. 15/277,362, filed on Sep. 27, 2016, now Pat. No. 10,128,575, which is a (Continued)

(30) Foreign Application Priority Data

Aug. 31, 2016 (CN) ..... 2016 1 07979816
Aug. 31, 2016 (CN) ..... 2016 2 10354327 U
(Continued)

(51) Int. Cl.
*H01Q 9/28* (2006.01)
*H01Q 1/36* (2006.01)
*H01Q 7/00* (2006.01)

(52) U.S. Cl.
CPC ..... *H01Q 9/285* (2013.01); *H01Q 1/36* (2013.01); *H01Q 7/00* (2013.01)

(58) Field of Classification Search
CPC ..... H01Q 9/285; H01Q 1/36; H01Q 7/00
See application file for complete search history.

(56) References Cited

U.S. PATENT DOCUMENTS 2,060,098 A 11/1936 Norman
2,220,008 A 10/1940 Woodward et al.
(Continued)

FOREIGN PATENT DOCUMENTS

CN 1474478 A 2/2004
CN ZL2008200072832 5/2009
(Continued)

OTHER PUBLICATIONS

IEEE Spectrum: Antennas for the New Airwaves, http://www.spectrum.ieee.org/print/7328, Published Feb. 2009, 9 pages, Authors Richard Schneider and John Ross.
(Continued)

*Primary Examiner* — Dieu Hien T Duong
(74) *Attorney, Agent, or Firm* — Harness, Dickey & Pierce, P.L.C.; Anthony G. Fussner

(57) ABSTRACT

Exemplary embodiments are disclosed of HDTV antenna assemblies. In an exemplary embodiment, a high definition television antenna assembly generally includes a first antenna element and a second antenna element. The first antenna element has a generally annular shape with an opening. The second antenna element includes first and second arms spaced apart from the first antenna element. The first and second arms extend at least partially along portions of the first antenna element. The first and second antenna elements may be electromagnetically coupled without a direct ohmic connection between the first and second antenna elements.

26 Claims, 33 Drawing Sheets

Related U.S. Application Data continuation-in-part of application No. 14/878,504, filed on Oct. 8, 2015, now Pat. No. 9,761,935, and a continuation-in-part of application No. 29/577,320, filed on Sep. 12, 2016, now Pat. No. Des. 811,752, which is a continuation-in-part of application No. 14/878,504, filed on Oct. 8, 2015, now Pat. No. 9,761,935, said application No. 15/277,362 is a continuation-in-part of application No. 29/577,321, filed on Sep. 12, 2016, now Pat. No. Des. 827,620, which is a continuation-in-part of application No. 14/878,504, filed on Oct. 8, 2015, now Pat. No. 9,761,935.

(60) Provisional application No. 62/213,437, filed on Sep. 2, 2015.

(30) Foreign Application Priority Data

Sep. 2, 2016 (TW) ..... 105128416 A
Sep. 2, 2016 (TW) ..... 105213526 U

(56) References Cited

U.S. PATENT DOCUMENTS 2,437,251 A 3/1948 Frische et al.
2,480,155 A 8/1949 Masters
2,551,664 A 5/1951 Galper
2,589,578 A 3/1952 Sabins
D168,325 S 12/1952 Abrams
D170,203 S 8/1953 Leonard
D171,560 S 2/1954 Ritter
D177,200 S 3/1956 Valiulis
D179,111 S 11/1956 Ballan
2,821,710 A 1/1958 Hale
3,015,101 A 12/1961 Turner et al.
3,123,826 A 3/1964 Durham
3,161,975 A 12/1964 McMillan
3,239,838 A 3/1966 Kelleher
3,261,019 A 7/1966 Lundy
D205,771 S 9/1966 Spiselman
3,273,158 A 9/1966 Fouts et al.
D209,402 S 11/1967 Burlingame
D211,025 S 5/1968 Callaghan
3,434,145 A 3/1969 Wells
D213,882 S 4/1969 Sonnenblick
3,560,983 A 2/1971 Willie et al.
3,587,105 A 6/1971 Neilson
3,721,990 A 3/1973 Gibson et al.
3,828,867 A 8/1974 Elwood
3,971,031 A 7/1976 Burke
D244,771 S 6/1977 Bott
4,183,027 A 1/1980 Ehrenspeck
4,184,163 A 1/1980 Woodward
D269,838 S 7/1983 Altonaga
4,418,427 A 11/1983 Muterspaugh
4,462,010 A * 7/1984 Strammello ..... H03H 7/461 333/126
D282,355 S 1/1986 Hartzell
D310,671 S 9/1990 Weiss
D312,923 S 12/1990 Bleazard
4,987,424 A * 1/1991 Tamura ..... H01Q 1/44 343/795
D318,673 S 7/1991 Terk
D324,780 S 3/1992 Sebesta
D327,690 S 7/1992 Ogawa et al.
D332,262 S 1/1993 Borchardt
5,280,645 A 1/1994 Nguyen et al.
D344,731 S 3/1994 Witzky
5,313,218 A 5/1994 Busking
D358,037 S 5/1995 Monroe
D366,764 S 2/1996 Hunt
D396,350 S 7/1998 Panzenhagen
D405,473 S 2/1999 Tikhonski et al.
5,943,025 A 8/1999 Benham et al.
D414,495 S 9/1999 Heiligenstein et al.
D421,610 S 3/2000 Ghalebi
6,054,963 A 4/2000 Muterspaugh
6,239,764 B1 5/2001 Timofeev et al.
D449,593 S 10/2001 Schultz
D452,995 S 1/2002 Barry
6,590,541 B1 7/2003 Schultze
6,593,886 B2 7/2003 Schantz
D480,221 S 10/2003 Luciano
D480,714 S 10/2003 Wang
D481,544 S 11/2003 Di Leggerini
6,680,708 B2 1/2004 Yamaki
D501,468 S 2/2005 Wang
6,885,352 B2 4/2005 Lee et al.
D504,687 S 5/2005 Lee et al.
6,917,793 B2 7/2005 Wang
D509,072 S 9/2005 Babich
D510,101 S 9/2005 Bushey
D519,117 S 4/2006 Lewis
D524,555 S 7/2006 Mohundro
D527,193 S 8/2006 Park
7,091,925 B1 8/2006 Wang
7,126,556 B1 10/2006 Wang
D532,823 S 11/2006 Pena Angarita
7,209,089 B2 4/2007 Schantz
D542,543 S 5/2007 Bruce
D544,471 S 6/2007 Wang
7,239,290 B2 7/2007 Poilasne et al.
7,245,266 B1 7/2007 Szente et al.
D548,981 S 8/2007 Ernetoft
D558,189 S 12/2007 Inoue
D575,531 S 8/2008 Paterson
D581,931 S 12/2008 Pine
D585,883 S 2/2009 Kaneko
D598,433 S 8/2009 Schneider et al.
D598,434 S 8/2009 Schneider et al.
7,609,222 B2 10/2009 Schneider et al.
D604,276 S 11/2009 Schneider et al.
D611,460 S 3/2010 Chao
7,693,570 B2 4/2010 Green et al.
D624,531 S 9/2010 Fleck et al.
7,839,347 B2 11/2010 Schneider et al.
7,839,351 B2 11/2010 Schadler et al.
7,898,496 B2 3/2011 Olsen et al.
D638,631 S 5/2011 Parisi et al.
7,936,311 B2 5/2011 Rowser et al.
7,990,335 B2 8/2011 Schneider et al.
D654,274 S 2/2012 Krawczyk
D666,178 S 8/2012 Schneider et al.
D666,619 S 9/2012 May
8,368,607 B2 2/2013 Schneider et al.
D677,474 S 3/2013 Harris et al.
D719,744 S 12/2014 Plumbo et al.
D719,746 S 12/2014 Dean, Jr.
D735,480 S 8/2015 Fallon
D782,211 S 3/2017 Randhawa
9,761,935 B2 9/2017 Ross, III et al.
10,128,575 B2 11/2018 Ross, III et al.
2002/0158798 A1 10/2002 Chiang et al.
2003/0071757 A1 4/2003 Yamaki
2004/0090379 A1 5/2004 Fourdeux et al.
2004/0090385 A1 5/2004 Green
2004/0113841 A1 6/2004 Louzir et al.
2004/0217912 A1 11/2004 Mohammadian
2005/0088342 A1 4/2005 Parsche
2005/0162332 A1 7/2005 Schantz
2005/0259023 A1 11/2005 Wang
2005/0280582 A1 12/2005 Powell et al.
2006/0033665 A1 2/2006 Yang
2006/0055618 A1 3/2006 Poilasne et al.
2006/0077115 A1 4/2006 Oh et al.
2006/0103577 A1 5/2006 Lee
2006/0164304 A1 7/2006 Huang et al.
2007/0069955 A1 3/2007 McCorkle
2007/0200769 A1 8/2007 Nakano et al.
2008/0094291 A1 4/2008 Bystrom et al.
2008/0211720 A1 9/2008 Hansen
2008/0258980 A1 10/2008 Chen et al.
2008/0291345 A1 11/2008 Schneider

(56) References Cited

U.S. PATENT DOCUMENTS

| | | | | |
|---|---|---|---|---|
| 2009/0058732 | A1 | 3/2009 | Nakano et al. | |
| 2009/0073067 | A1 | 3/2009 | Soler Castany et al. | |
| 2009/0146899 | A1 | 6/2009 | Schneider et al. | |
| 2009/0146900 | A1* | 6/2009 | Schneider | H01Q 1/36 343/834 |
| 2009/0289853 | A1* | 11/2009 | Tinaphong | H01Q 1/38 343/700 MS |
| 2010/0085269 | A1 | 4/2010 | Sadowski et al. | |
| 2012/0013513 | A1 | 1/2012 | Yukimasa | |
| 2012/0169553 | A1 | 7/2012 | Nomura et al. | |
| 2012/0249396 | A1 | 10/2012 | Parsche | |
| 2013/0162487 | A1 | 6/2013 | Schneider | |
| 2014/0292597 | A1 | 10/2014 | Schneider et al. | |
| 2017/0062939 | A1 | 3/2017 | Ross, III et al. | |

FOREIGN PATENT DOCUMENTS

| | | | |
|---|---|---|---|
| CN | ZL2008301199963 | | 5/2009 |
| CN | 10145305 | | 6/2009 |
| CN | ZL2008301199978 | | 7/2009 |
| CN | ZL2008300091398 | | 9/2009 |
| CN | 203589214 | U | 5/2014 |
| EM | 000946587 | | 5/2008 |
| EP | 1555717 | A1 | 7/2005 |
| EP | 1653560 | A1 | 5/2006 |
| EP | 1753080 | A1 | 2/2007 |
| GB | 2263360 | A | 7/1993 |
| JP | D1213590 | | 6/2004 |
| TW | M249233 | U | 11/2004 |
| TW | D112283 | | 8/2006 |
| TW | D119092 | | 9/2007 |
| TW | 200926506 | A | 6/2009 |
| TW | D129744 | | 7/2009 |
| TW | D129745 | | 7/2009 |
| TW | D129746 | | 7/2009 |
| WO | WO-2009073249 | A1 | 6/2009 |

OTHER PUBLICATIONS

Antenna Engineering Handbook, 3rd Edition, Edited by Richard C. Johnson, McGraw Hill, 1993, pp. 5-13 to 5-16.

One-Element Loop Antenna with Finite Reflector, B. Rojarayanont and T. Sekiguchi, Electronics & Communications in Japan, vol. 59-B, No. 5, May 1976, p. 68.

Frequency-and Time-Domain Modeling of Tapered Loop Antennas in Ultra-Wideband Radio Systems, Shiou-Li Chen and Shau-Gang Mao, Graduate Institute of Computer and Communication Engineer, pp. 179-182, IEEE copyright notice 2006.

Planar Miniature Tapered-Slot-Fed Annular Slot Antennas for Ultrawide-Band Radios, Tzyh-Ghuang Ma, Student Member, and Shyh-Kang, Jeng, Senior Member, IEEE, IEEE Transactions on Antennas and Propagation, vol. 53, No. 3, Mar. 2005, pp. 1194-1202.

Self-Mutual Admittances of Two Identical Circular Loop Antennas in a Conducting Medium and in Air, K. Iizuka, Senior Member, IEEE, R. W. P. King, Fellow, IEEE, and C. W. Harrison, Jr., Senior Member, IEEE, IEEE Transactions on Antennas and Propagation, vol. AP014, No. 4, Jul. 1966, pp. 440-450.

A Broadband Eccentric Annular Slot Antenna, Young Hoon Suh and Ikmo Park, Department of Electrical Engineering, Ajou University, pp. 94-97, IEEE copyright notice 2001.

A Printed Crescent Patch Antenna for Ultrawideband Applications, Ntsanderh C. Azenui an H.Y.D. Yang, IEEE Antennas and Wireless Propragation Letters, vol. 6, 2007, pp. 113-116.

Design of Compact Components for Ultra Wideband Communication Front Ends, Marek Bialkowski, Amin Abbosh, and Hing Kan, School of Information Technology and Electrical Engineering, The University of Queensland, four pages.

Nonfinal Office Action dated Apr. 17, 2012 from U.S. Appl. No. 29/376,791 which is a continuation of the instant application; 8 pages.

Tofel, Kevin C., HD Picture frame antenna, Aug. 11, 2005, <http://hd.engadget.com/2005/08/11/hd-picture-frame-antenna>, 1 page.

Antennas Direct, PF7 Picture Frame Antenna, Oct. 1, 2005, Antennas Direct, <http://web.archive.org/web/20051001020653/http://antennasdirect.com/PF7_antenna.html>, 1 page.

United States Office Action dated Sep. 13, 2011, issued by the United States Patent and Trademark Office in U.S. Appl. No. 12/126,593, which shares a common inventor with the instant application, 13 pages.

European Search Report dated Jan. 17, 2011, issued by the European Patent Office for European Patent Application No. EP 10193159.0 which is related to the instant application through a priority claim; (5 pages).

European Supplementary Search Report and Opinion dated Oct. 7, 2010, issued by the European Patent Office for European Patent Application No. EP 08747115 (6 pages).

Clearstream™ 2V; <http://www.antennasdirect.com/cmss_files/attachmentlibrary/pdf/C2-V_QS_FINAL_20120702.pdf>; Jul. 2, 2012; 2 pgs.

Mao S-G et al., "Time-domain characteristics of ultra-wideband tapered loop antennas", Electronics Letters, IEE Stevenage, GB, vol. 42, No. 22, Oct. 26, 2006; 1262-1264; 2 pgs.

European Search Report dated Apr. 24, 2014 for EP application No. 14153878.5 which has the same priority claim as the instant application; 9 pgs.

Notice of Allowance dated Jan. 25, 2018 for U.S. Appl. No. 29/587,310, filed Dec. 12, 2016 which is the parent application to the instant application. 12 pages.

Notice of Allowance dated Apr. 13, 2017 for U.S. Appl. No. 14/878,504, filed Oct. 8, 2015 (published as US20170062919 on Mar. 2, 2017) which is the parentapplication to the instant application, 10 pages.

Chinese office action (and its English translation) for Chinese application No. 201610797981.6 which claims priority to the same parent application as the instant application, dated Nov. 21, 2018, 18 pages.

* cited by examiner

HDTV ANTENNA ASSEMBLIES

CROSS REFERENCE TO RELATED APPLICATIONS

This application is a continuation of U.S. patent application Ser. No. 15/277,362 filed Sep. 27, 2016, which, in turn, is a continuation-in-part of U.S. Design patent application No. 29/577,320 filed Sep. 12, 2016, which, in turn, is a continuation-in-part of U.S. Utility patent application Ser. No. 14/878,504 filed Oct. 8, 2015 which claims the benefit of U.S. Provisional Application No. 62/213,437 filed Sep. 2, 2015.

U.S. patent application Ser. No. 15/277,362 is a continuation-in-part of U.S. Design patent application No. 29/577,321 filed Sep. 12, 2016, which, in turn, is a continuation-in-part of U.S. Utility patent application Ser. No. 14/878,504 filed Oct. 8, 2015 which claims the benefit of U.S. Provisional Application No. 62/213,437 filed Sep. 2, 2015.

This application claims the benefit of and priority to Chinese Invention Patent Application No. 2016107979816 filed Aug. 31, 2016, which, in turn, claims the benefit of and priority to U.S. Provisional Application No. 62/213,437 filed Sep. 2, 2015 and U.S. Utility patent application Ser. No. 14/878,504 filed Oct. 8, 2015.

This application claims the benefit of and priority to Chinese Utility Model Application No. 2016210354327 filed Aug. 31, 2016, which, in turn, claims the benefit of and priority to U.S. Provisional Application No. 62/213,437 filed Sep. 2, 2015 and U.S. Utility patent application Ser. No. 14/878,504 filed Oct. 8, 2015.

This application claims the benefit of and priority to Taiwanese Invention Patent Application No. 105128416 filed Sep. 2, 2016, which, in turn, claims the benefit of and priority to U.S. Provisional Application No. 62/213,437 filed Sep. 2, 2015 and U.S. Utility patent application Ser. No. 14/878,504 filed Oct. 8, 2015.

This application claims the benefit of and priority to Taiwanese Utility Model Application No. 105213526 filed Sep. 2, 2016, which, in turn, claims the benefit of and priority to U.S. Provisional Application No. 62/213,437 filed Sep. 2, 2015 and U.S. Utility patent application Ser. No. 14/878,504 filed Oct. 8, 2015.

This application is a continuation-in-part of U.S. Design patent application No. 29/577,320 filed Sep. 12, 2016, which, in turn, is a continuation-in-part of U.S. Utility patent application Ser. No. 14/878,504 filed Oct. 8, 2015 and also claims the benefit of and priority to Chinese Invention Patent Application No. 2016107979816 filed Aug. 31, 2016, Chinese Utility Model Application No. 2016210354327 filed Aug. 31, 2016, Taiwanese Invention Patent Application No. 105128416 filed Sep. 2, 2016, and Taiwanese Utility Model Application No. 105213526 filed Sep. 2, 2016.

This application is a continuation-in-part of U.S. Design patent application No. 29/577,321 filed Sep. 12, 2016, which, in turn, is a continuation-in-part of U.S. Utility patent application Ser. No. 14/878,504 filed Oct. 8, 2015 and also claims the benefit of and priority to Chinese Invention Patent Application No. 2016107979816 filed Aug. 31, 2016, Chinese Utility Model Application No. 2016210354327 filed Aug. 31, 2016, Taiwanese Invention Patent Application No. 105128416 filed Sep. 2, 2016, and Taiwanese Utility Model Application No. 105213526 filed Sep. 2, 2016.

The entire disclosures of the above applications are incorporated herein by reference.

FIELD

The present disclosure generally relates to HDTV antenna assemblies.

BACKGROUND

This section provides background information related to the present disclosure which is not necessarily prior art.

Many people enjoy watching television. The television-watching experience has been greatly improved due to high definition television (HDTV). A great number of people pay for HDTV through their existing cable or satellite TV service provider. But HDTV signals are commonly broadcast over the free public airwaves. This means that HDTV signals may be received for free with the appropriate antenna.

DRAWINGS

The drawings described herein are for illustrative purposes only of selected embodiments and not all possible implementations, and are not intended to limit the scope of the present disclosure.

FIG. 1 illustrates an HDTV antenna assembly including antenna elements on a substrate according to an exemplary embodiment;

FIG. 2 illustrates a prototype HDTV antenna assembly including antenna elements on a substrate, a balun (e.g., 75 ohm 1:1 balun, etc.), a connector (e.g., a type F Female connector), and a feed (e.g., 75 ohm balanced input, etc.) to the VHF antenna elements according to an exemplary embodiment, where the ruler and antenna dimensions in inches gleaned therefrom are provided for purpose of illustration only;

Figure 16:
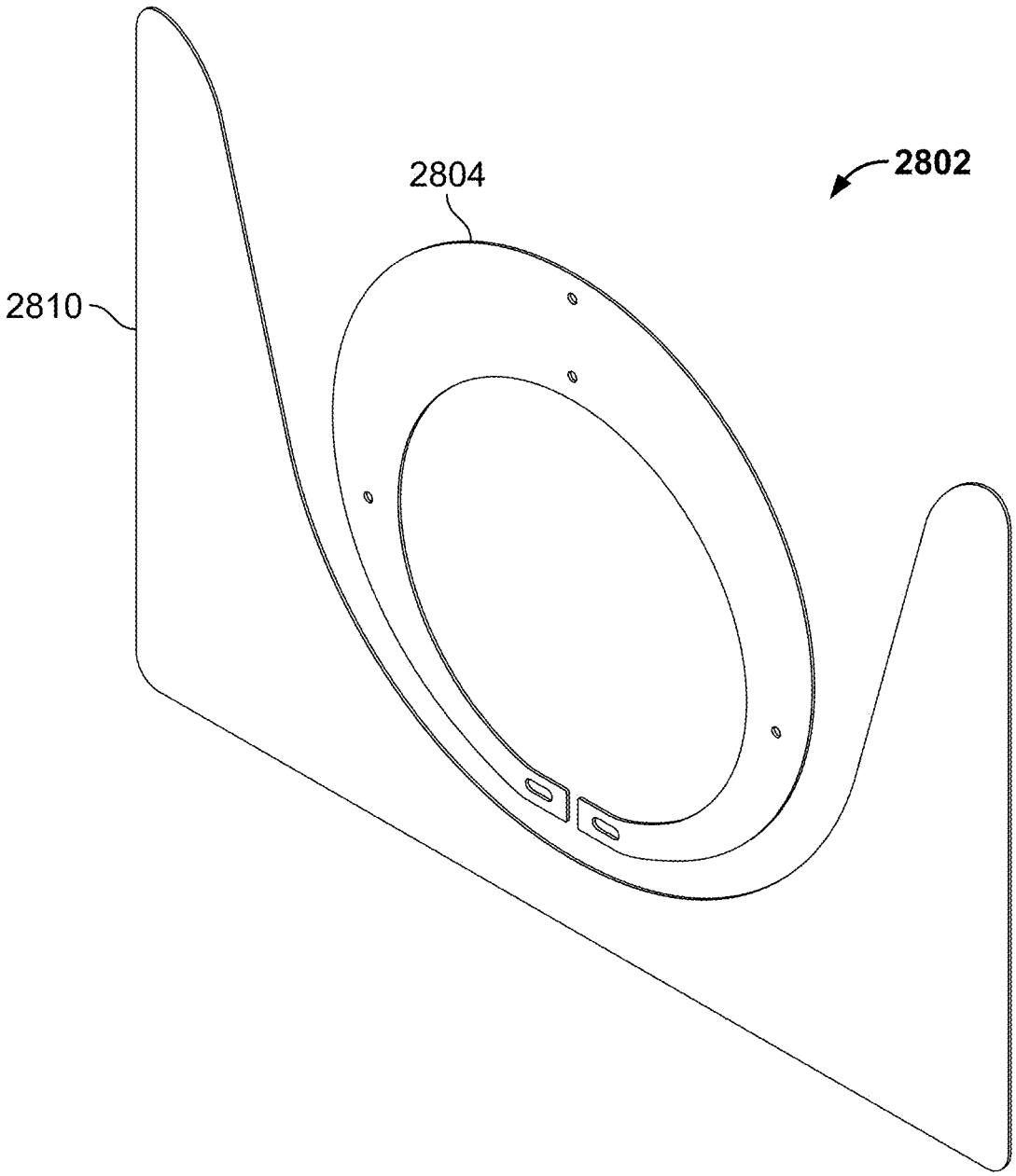
FIG. 16 is a perspective view of UHF and VHF antenna elements according to another exemplary embodiment in which the UHF and VHF antenna elements are electromagnetically coupled without a direct ohmic connection between the UHF and VHF antenna elements.
Figure 17:
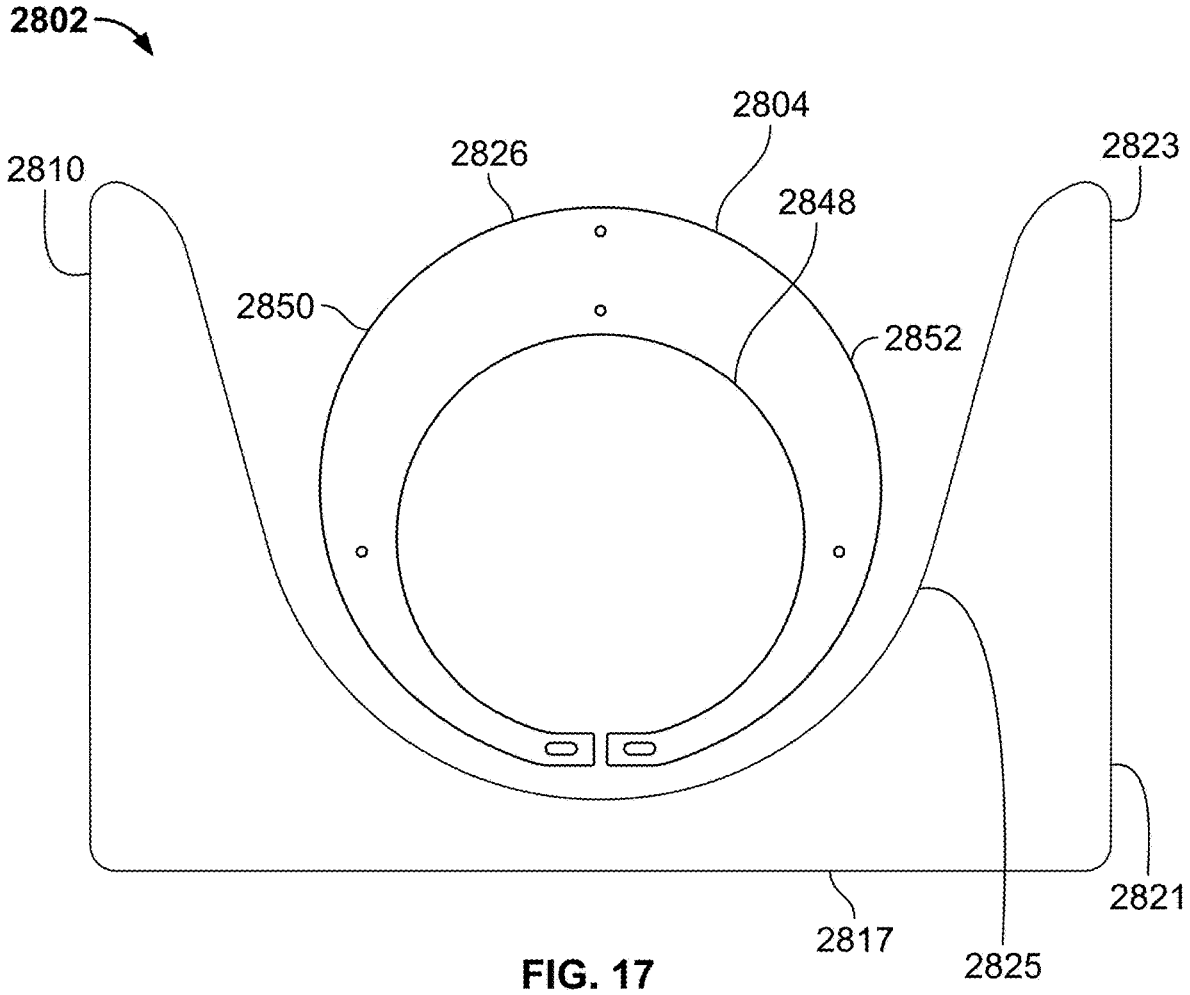
FIG. 17 is a front view of the antenna elements shown in FIG. 15.
Figure 18:
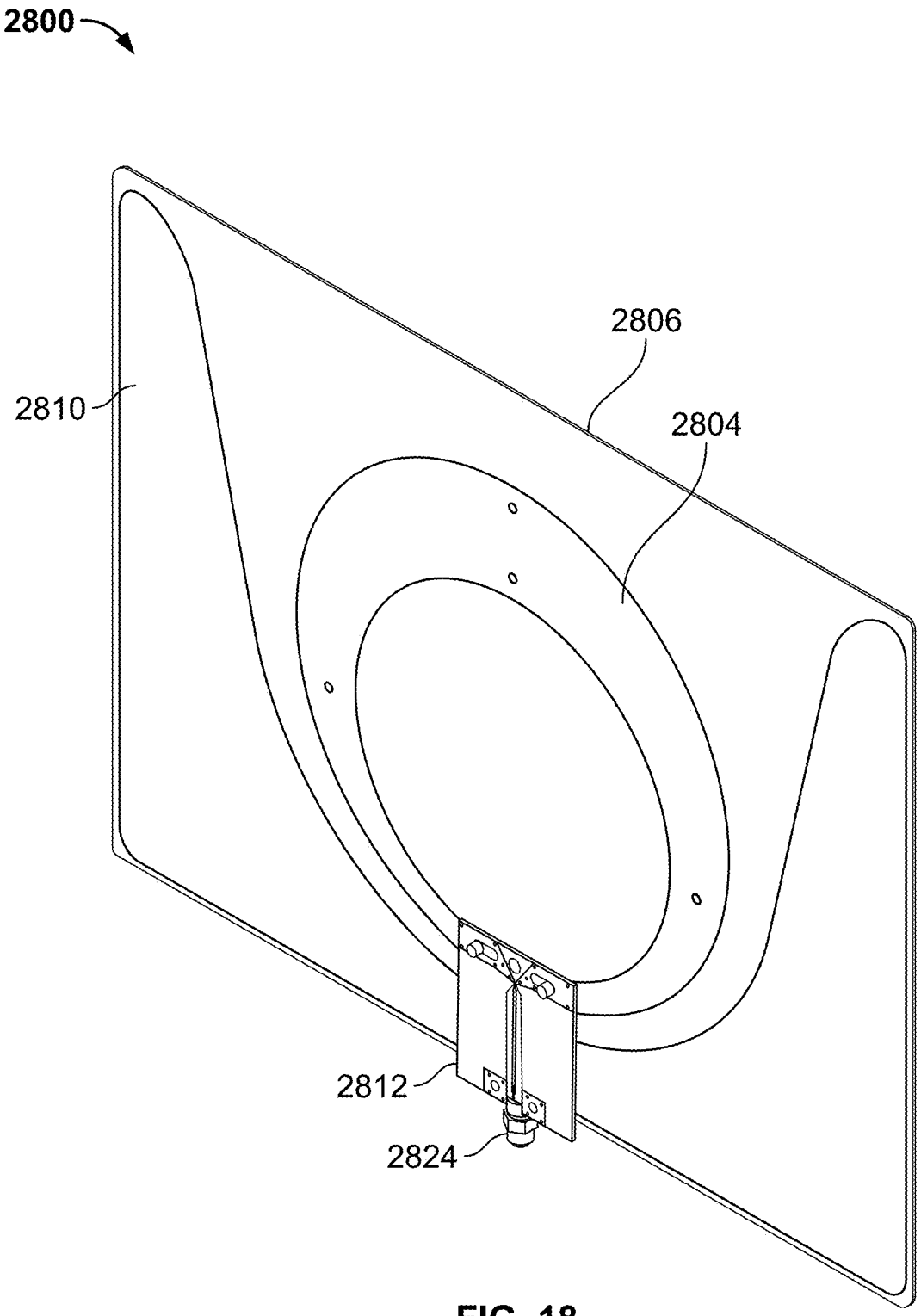
Figure 19:
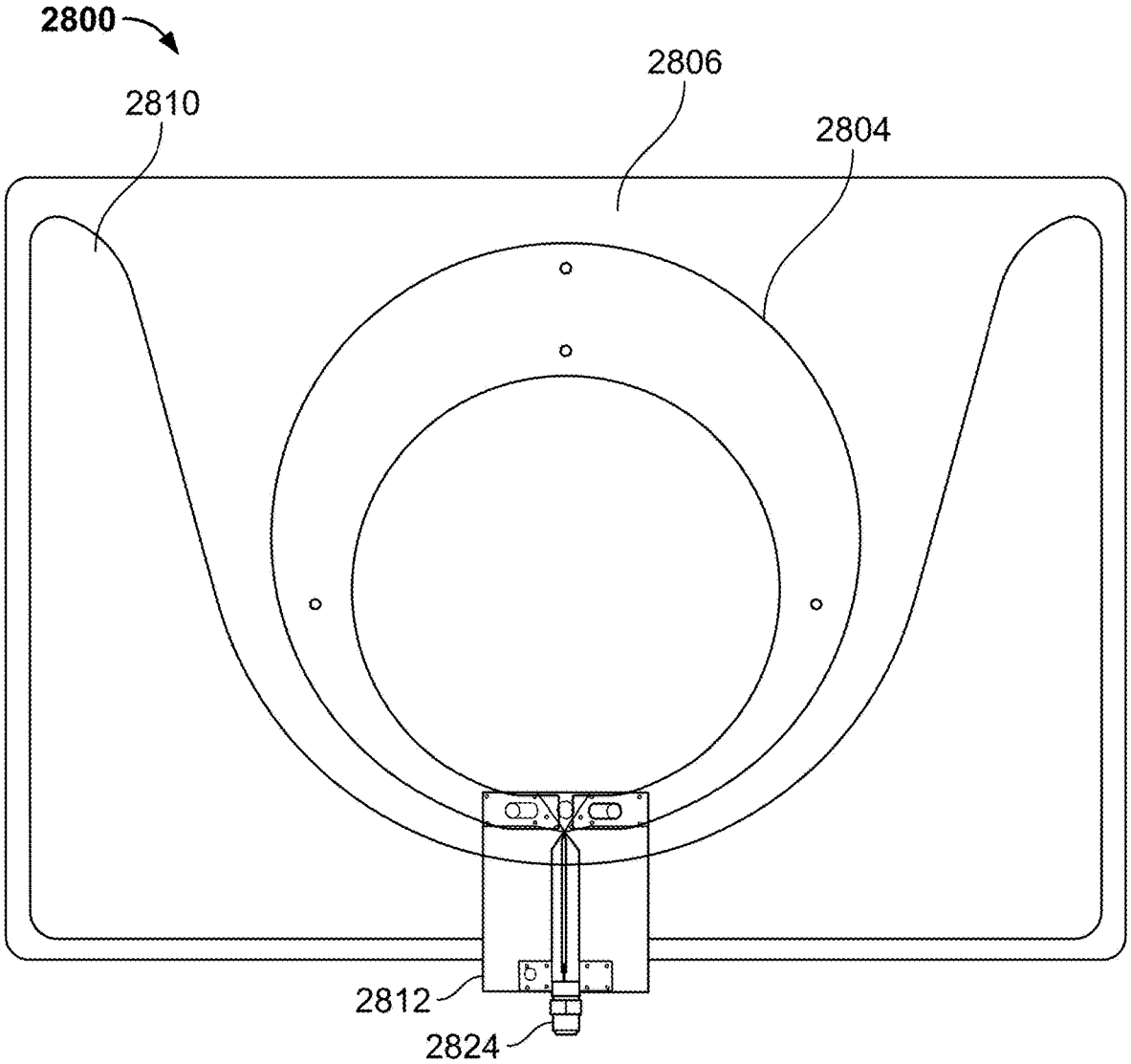
Figure 20:
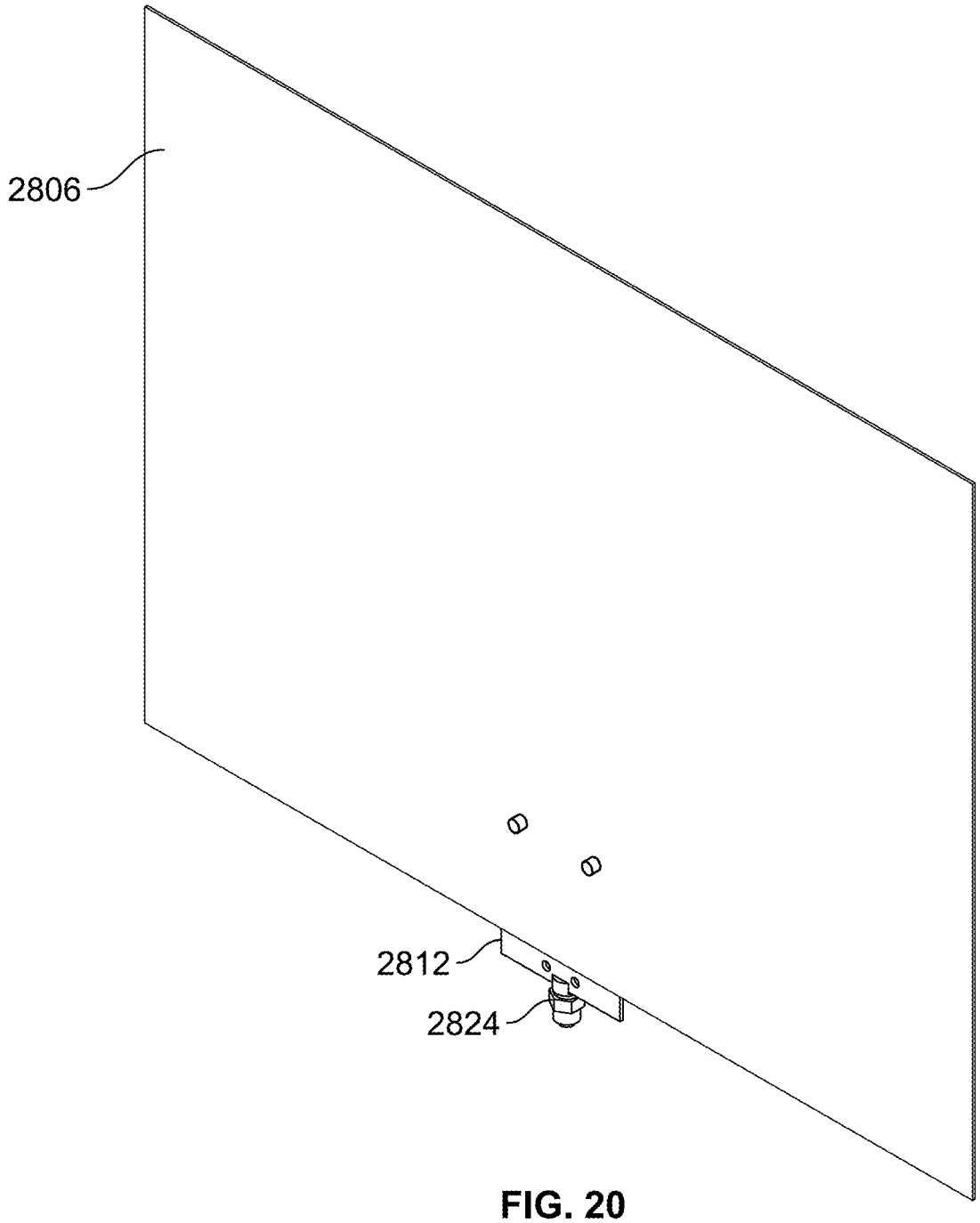
Figure 21:
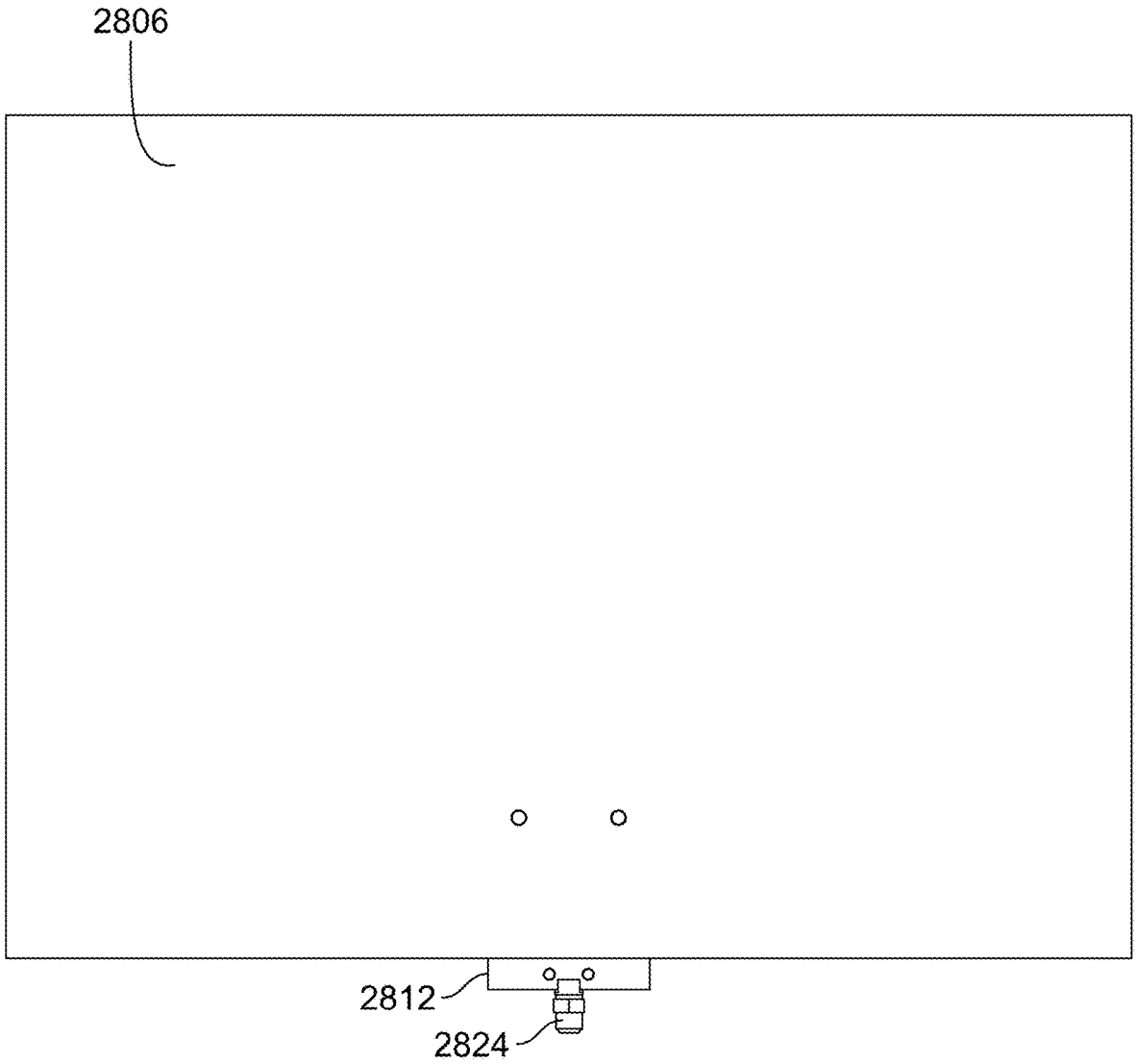
Figure 22:
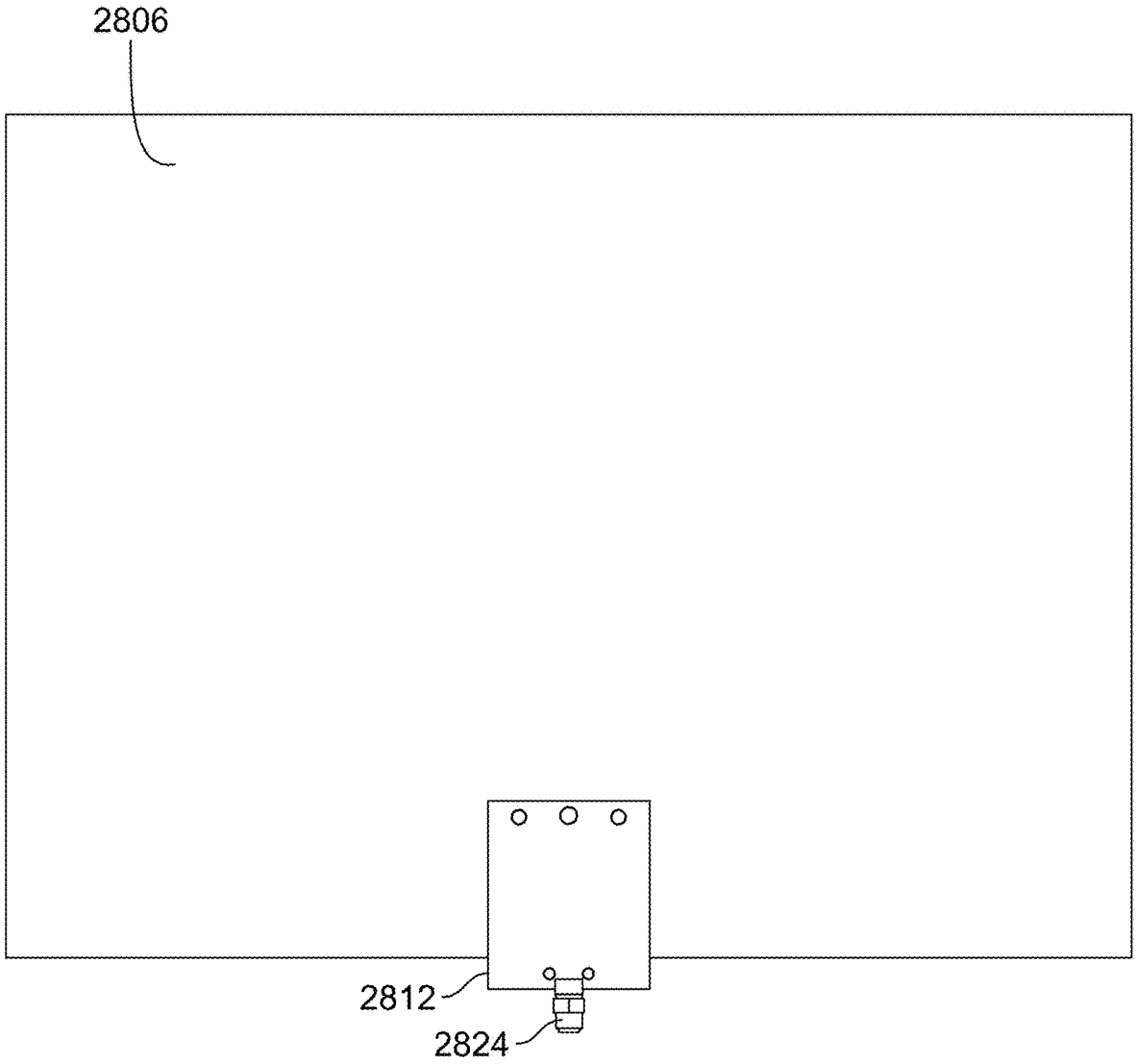
Figure 23:
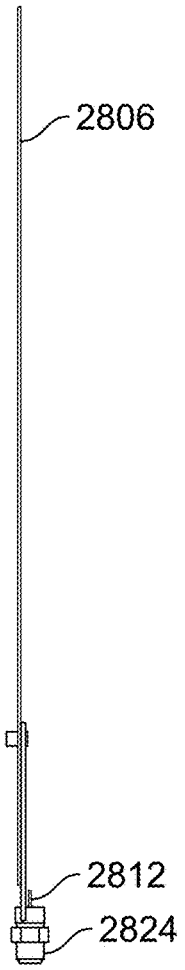
Figure 24:
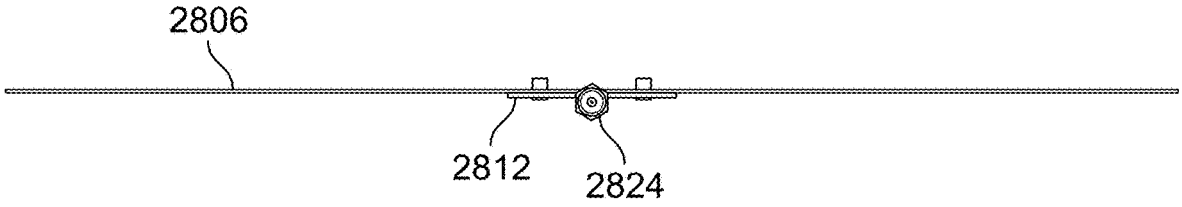
Figure 25:
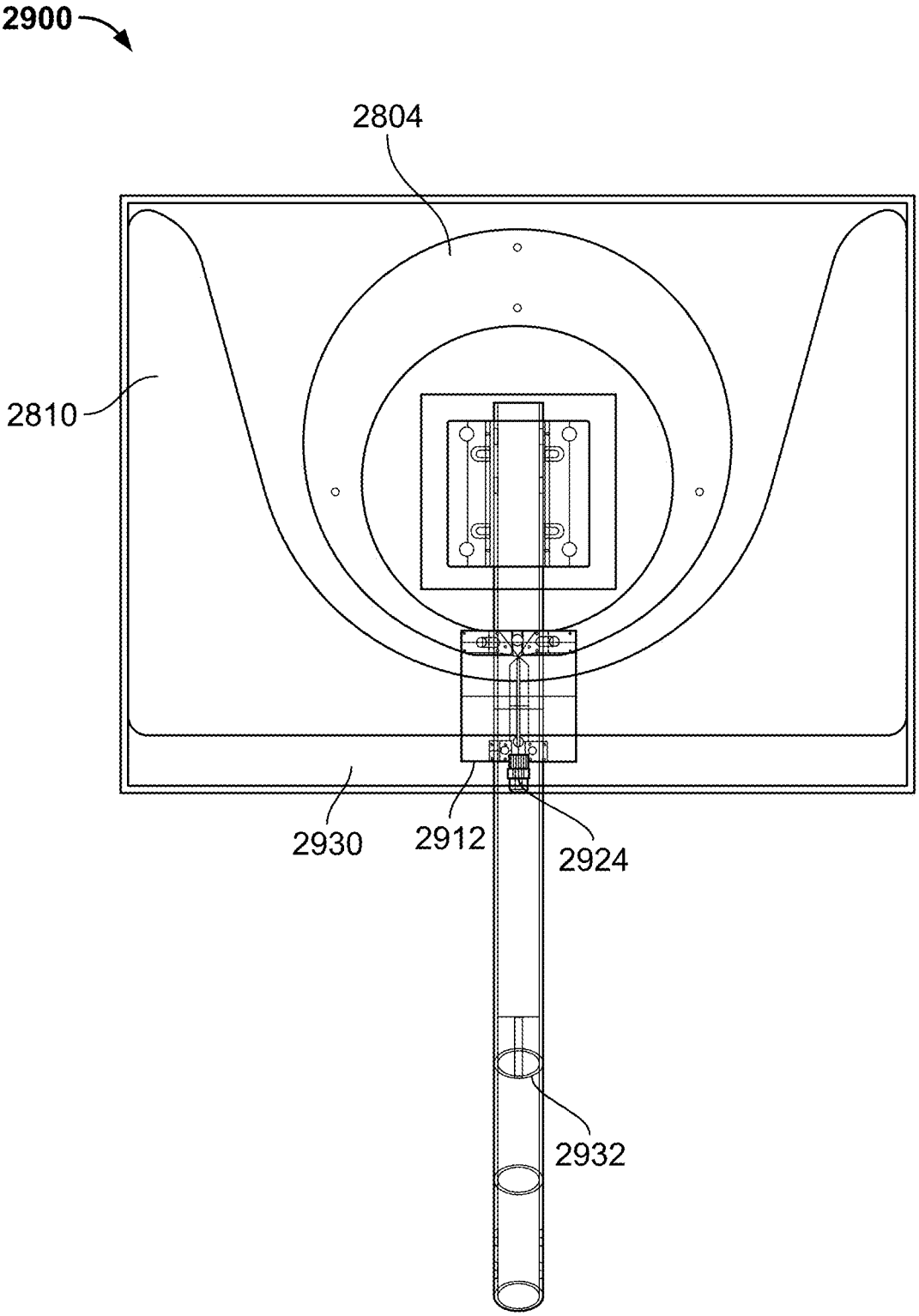
Figure 26:
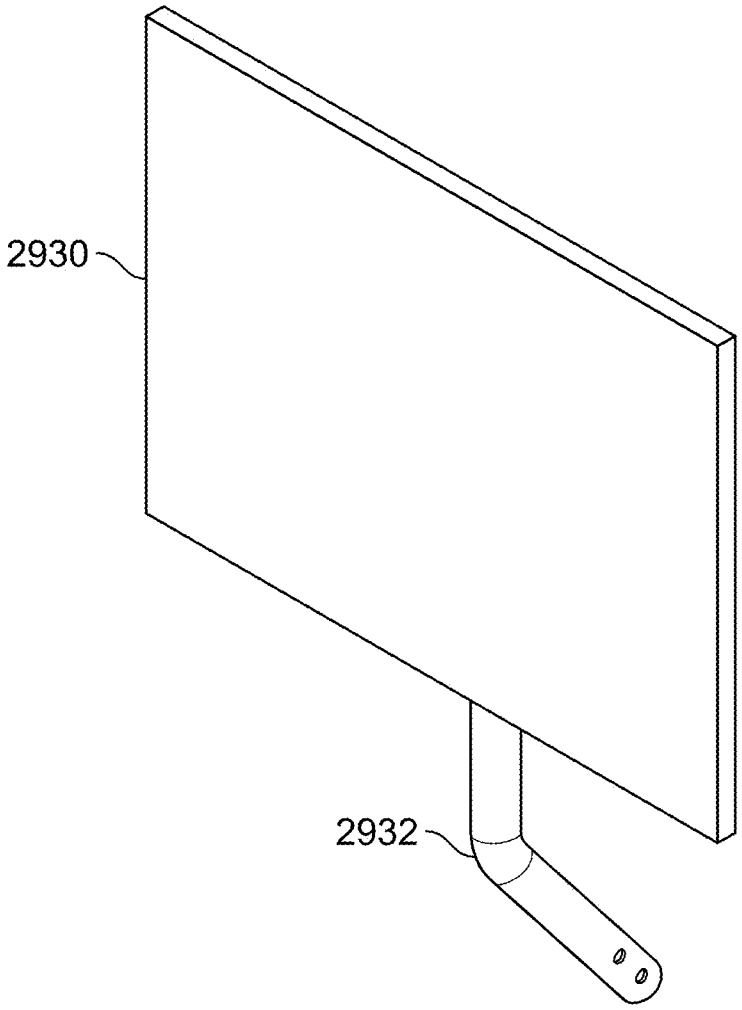
Figure 27:
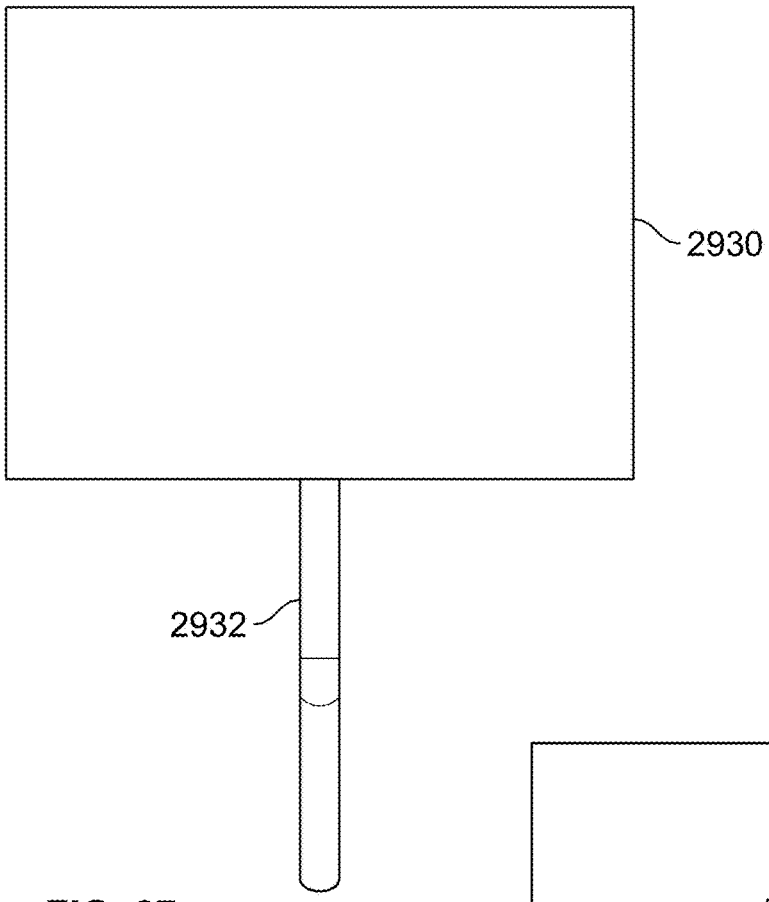
Figure 28:
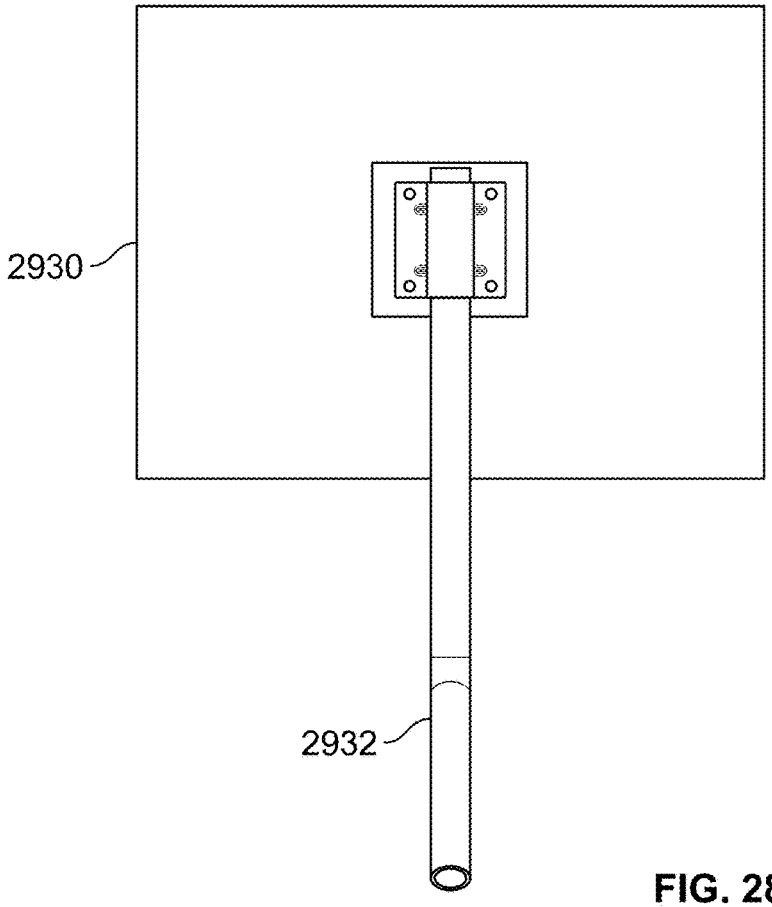
Figure 29:
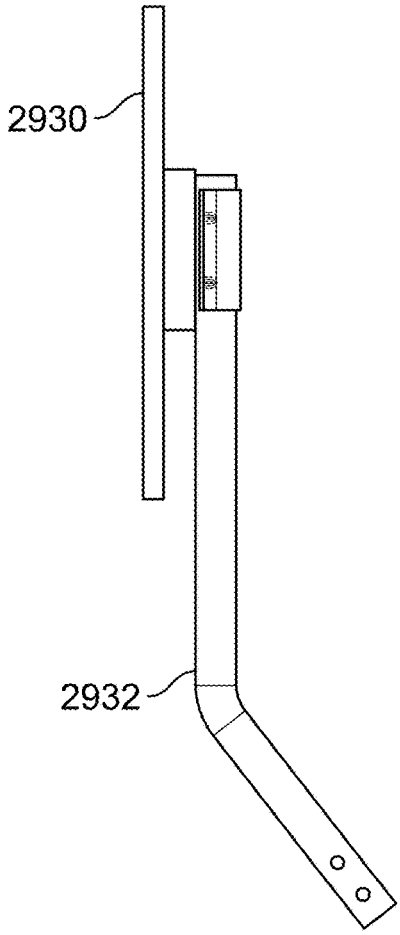
Figure 30:
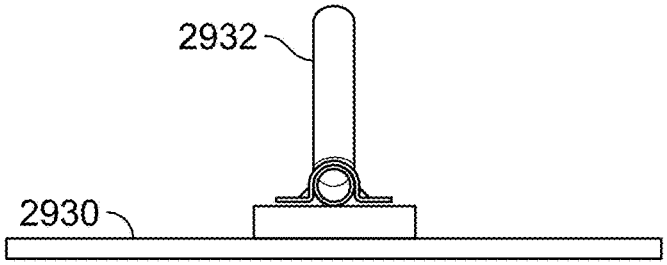
Figure 31:
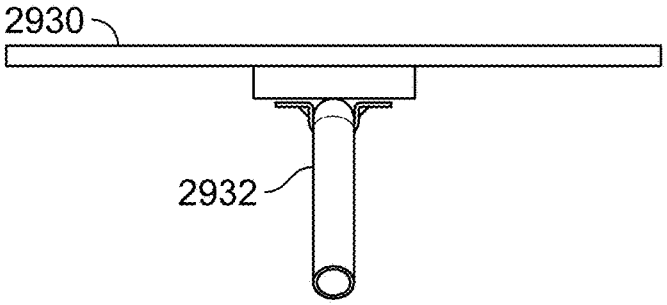
Figure 32:
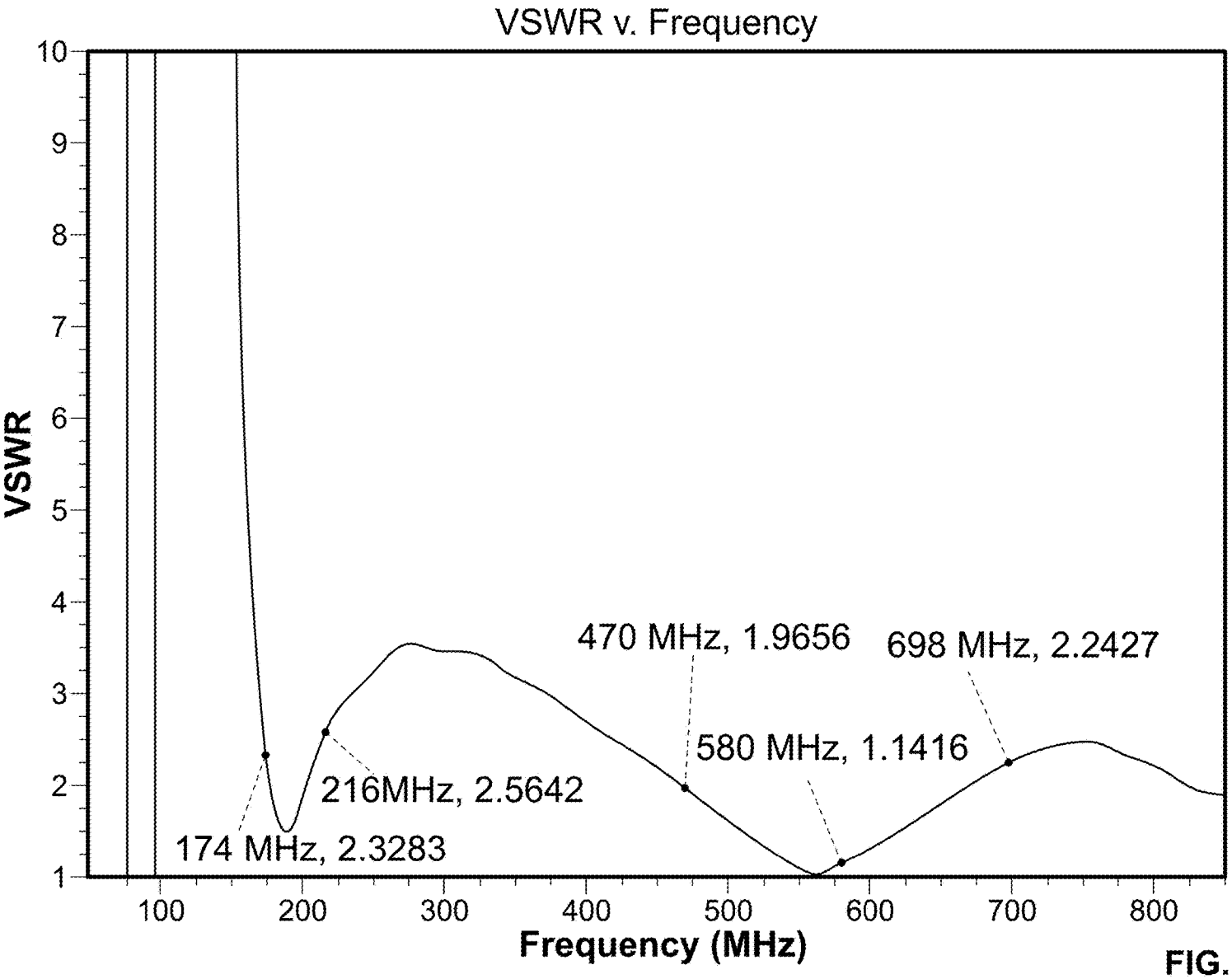
Figure 33:
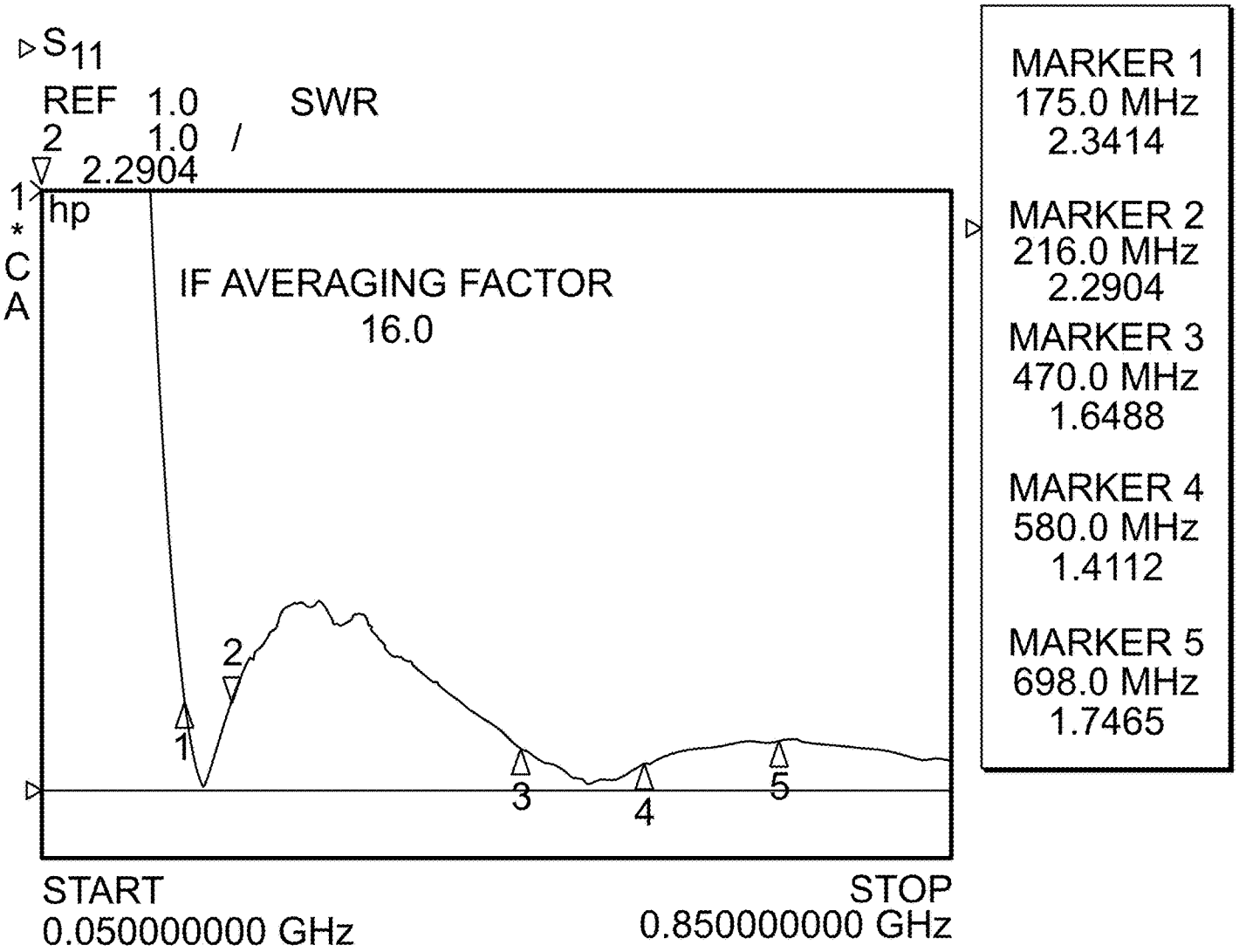
Figure 34:
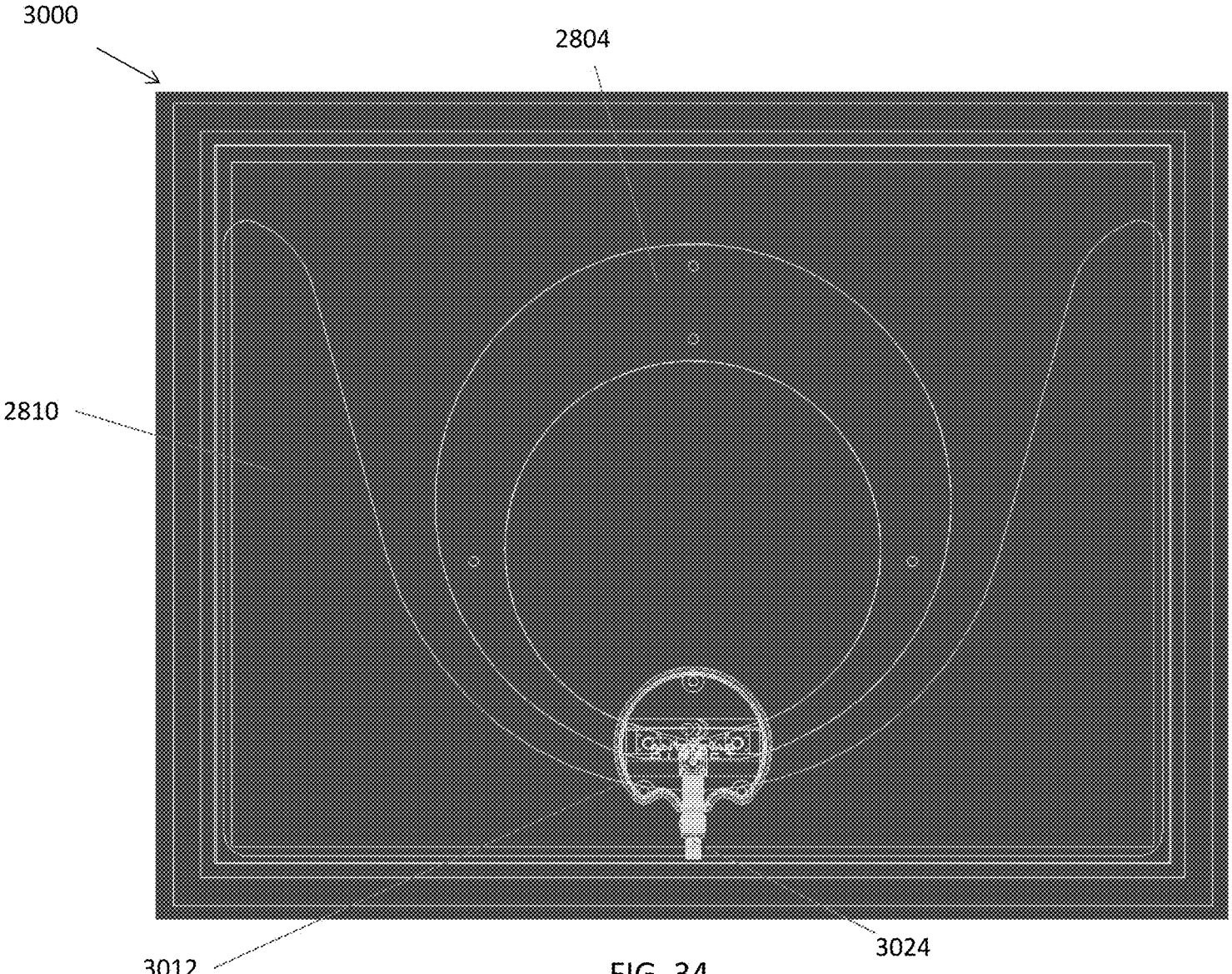
Figure 35:
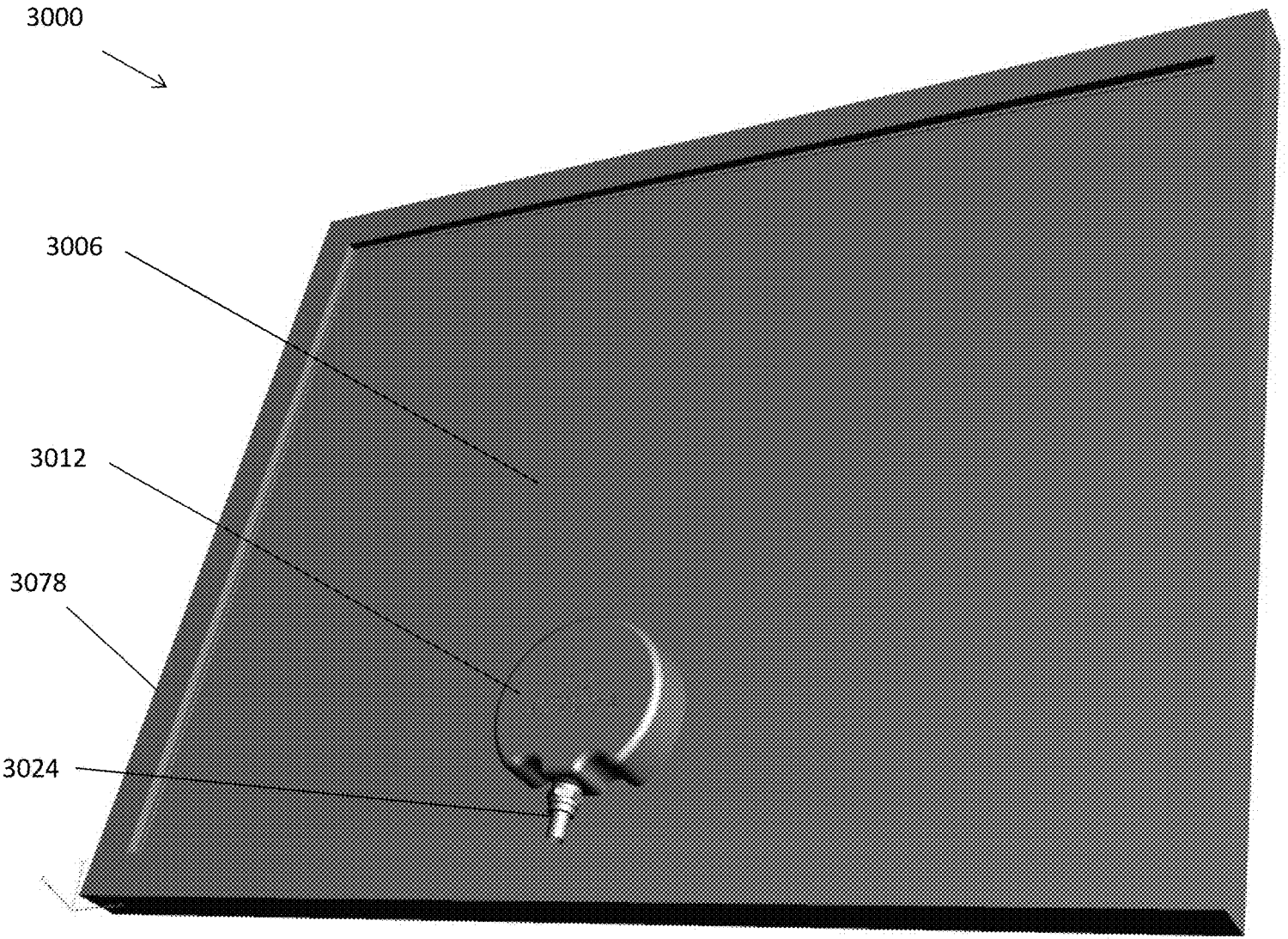
Figure 36:
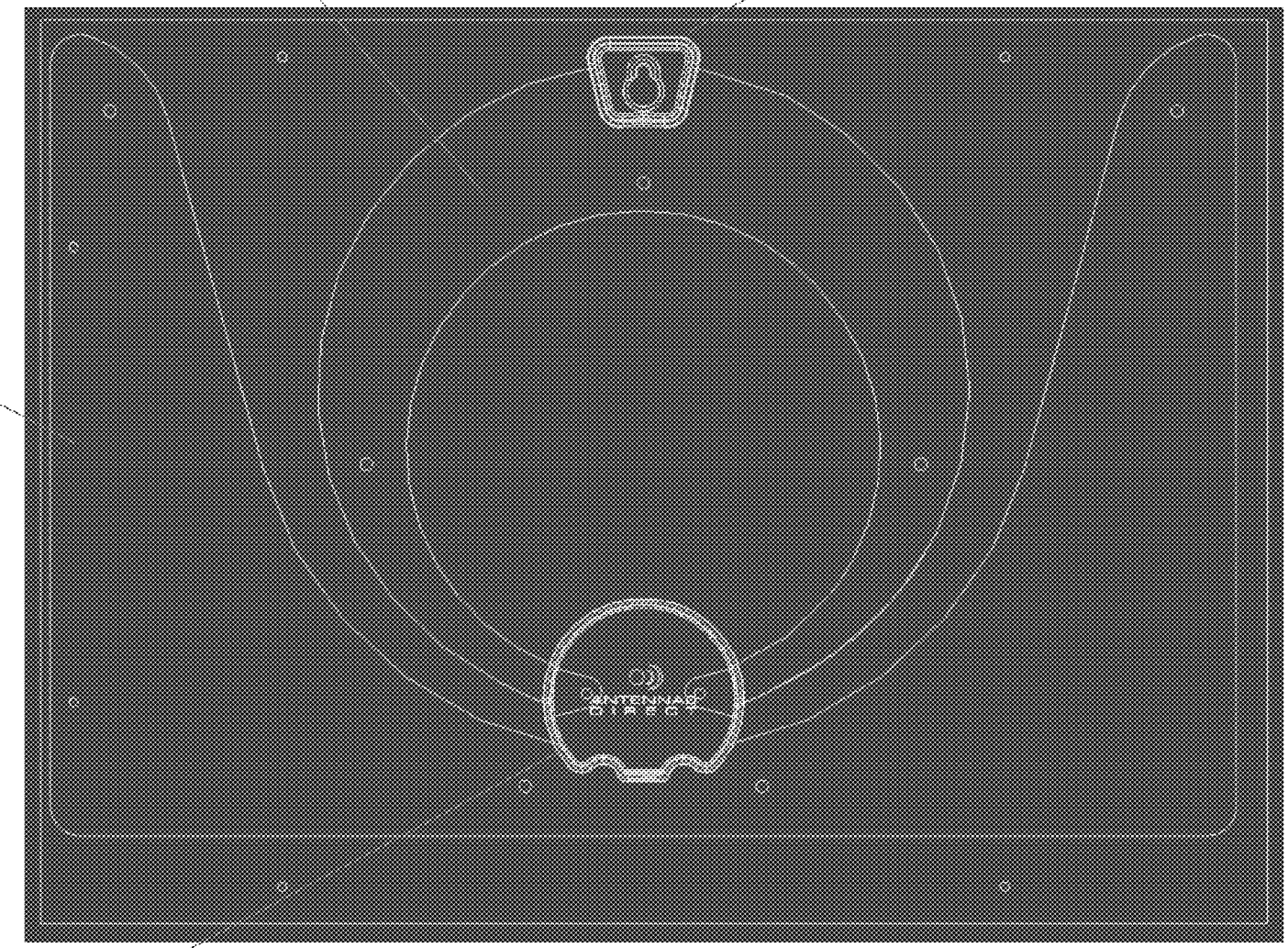
Figure 37:
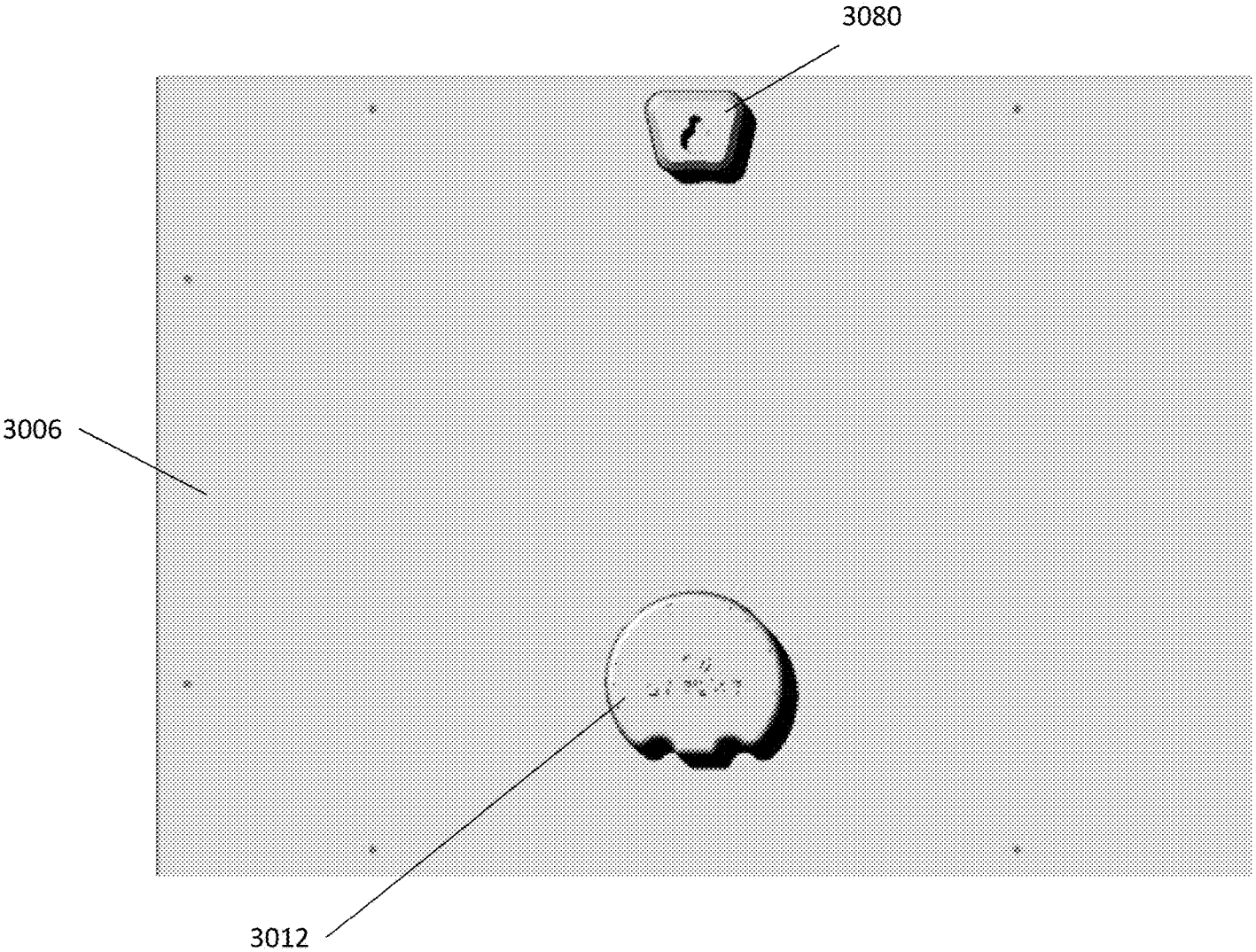

FIG. 18 is a perspective view of an HDTV antenna assembly including the UHF and VHF antenna elements (e.g., made from 0.35 mm thick copper foil, etc.) shown in FIGS. 16 and 17 and disposed on a substrate (e.g., 0.4 mm thick polypropylene substrate, etc.), a balun (e.g., a 75 to 300 ohm balun, etc.), a connector (e.g., a type F Female connector), and a feed (e.g., 300 ohm balanced input, etc.) to the UHF tapered loop antenna element according to an exemplary embodiment in which the HDTV antenna assembly is configured for indoor use;

FIG. 19 is a front view of the HDTV antenna assembly shown in FIG. 18;

FIG. 20 is a perspective view of the substrate, balun, and connector shown in FIG. 18 with the UHF and VHF antenna elements covered in a layer of polypropylene or other suitable cover material;

FIG. 21 is a front view of the substrate, balun, connector, and UHF and VHF antenna elements covered in a layer of polypropylene or other suitable cover material as shown in FIG. 20;

FIG. 22 is a back view of the substrate, balun, connector, and UHF and VHF antenna elements covered in a layer of polypropylene or other suitable cover material as shown in FIG. 20;

FIG. 23 is a side view of the substrate, balun, connector, and UHF and VHF antenna elements covered in a layer of polypropylene or other suitable cover material as shown in FIG. 20;

FIG. 24 is a bottom view of the substrate, balun, connector, and UHF and VHF antenna elements covered in a layer of polypropylene or other suitable cover material as shown in FIG. 20;

FIG. 25 illustrates an HDTV antenna assembly including the UHF and VHF antenna elements shown in FIGS. 16 and 17 enclosed within a housing or radome (e.g., a PA-756 ABS radome, etc.), a balun (e.g., 75 to 300 ohm balun, etc.), a connector (e.g., a type F Female connector), and a feed (e.g., 300 ohm balanced input, etc.) to the UHF tapered loop antenna element, and a mounting pole according to an exemplary embodiment in which the HDTV antenna assembly is configured for outdoor use;

FIG. 26 is a perspective view of the radome and mounting pole shown in FIG. 25;

FIG. 27 is a front view of the radome and mounting pole shown in FIG. 26;

FIG. 28 is a back view of the radome and mounting pole shown in FIG. 26;

FIG. 29 is a side view of the radome and mounting pole shown in FIG. 26;

FIG. 30 is a top view of the radome and mounting pole shown in FIG. 26;

FIG. 31 is a bottom view of the radome and mounting pole shown in FIG. 26;

FIGS. 32 and 33 are exemplary line graphs showing computer-simulated results and measured results of VSWR (voltage standing wave ratio) versus frequency for a prototype of an HDTV antenna assembly including UHF and VHF antenna elements as shown in FIGS. 16 and 17 that were made of aluminum foil and disposed on a substrate made of a plexiglass sheet;

FIG. 34 illustrates an HDTV antenna assembly including the UHF and VHF antenna elements shown in FIGS. 16 and 17 enclosed within or integrated into a picture or photo frame, and also illustrating a balun (e.g., 75 to 300 ohm balun, etc.) along a backplane or backing of the picture frame according to an exemplary embodiment;

FIG. 35 is a perspective showing the balun, backing or backplane, and perimeter frame member shown in FIG. 34;

FIG. 36 illustrates the UHF and VHF antenna elements, balun, and backing or backplane shown in FIG. 34, and also illustrating a hanger (e.g., keyhole frame hanger, etc.) along the backing or backplane according to an exemplary embodiment; and FIG. 37 illustrates the backing or backplane, balun, and hanger shown in FIG. 36.

Corresponding reference numerals indicate corresponding parts throughout the drawings.

DETAILED DESCRIPTION

Example embodiments will now be described more fully with reference to the accompanying drawings.

The United States frequency allocations for HDTV broadcasts currently include the low VHF band from 54 MHz to 88 MHz, the high VHF band from 174 MHz to 216 MHz, and the UHF band from 470 MHz to 698 MHz. The vast majority of stations are currently broadcasting in the high VHF and UHF bands.

As a general rule, antenna size is inversely proportional to the frequency. Therefore, antennas intended for low VHF band reception must be considerably larger than those intended for use in the high VHF and UHF bands. For the most part, consumers generally desire to have smaller antennas than larger antennas whenever possible. The smaller antennas are easier to install and do not detract from the aesthetics of a home or neighborhood. Smaller antennas also enable consumers to receive HDTV signals in mobile environments, such as an RV or camper, etc. Retailers also prefer smaller antennas due to the lower shipping fees and the fact that they take up less room on the retail shelf thus increasing revenues.

Given that the vast majority of HDTV broadcasts are currently limited to the high VHF and UHF bands, and that most consumers and retailers desire the smallest antenna possible, it makes sense to offer a compact antenna that covers only the high VHF and UHF bands. After recognizing the above, antenna assemblies were developed and are disclosed herein that meet this need for a compact dual band high VHF/UHF antenna for HDTV reception. Exemplary embodiments of antenna assemblies disclosed herein do not require the use of a diplexer to combine signals from separate high VHF and UHF elements. In such embodiments, the antenna assembly therefore retains higher signal efficiency at lower cost than antenna assemblies comprised of separate elements.

Figure 1:
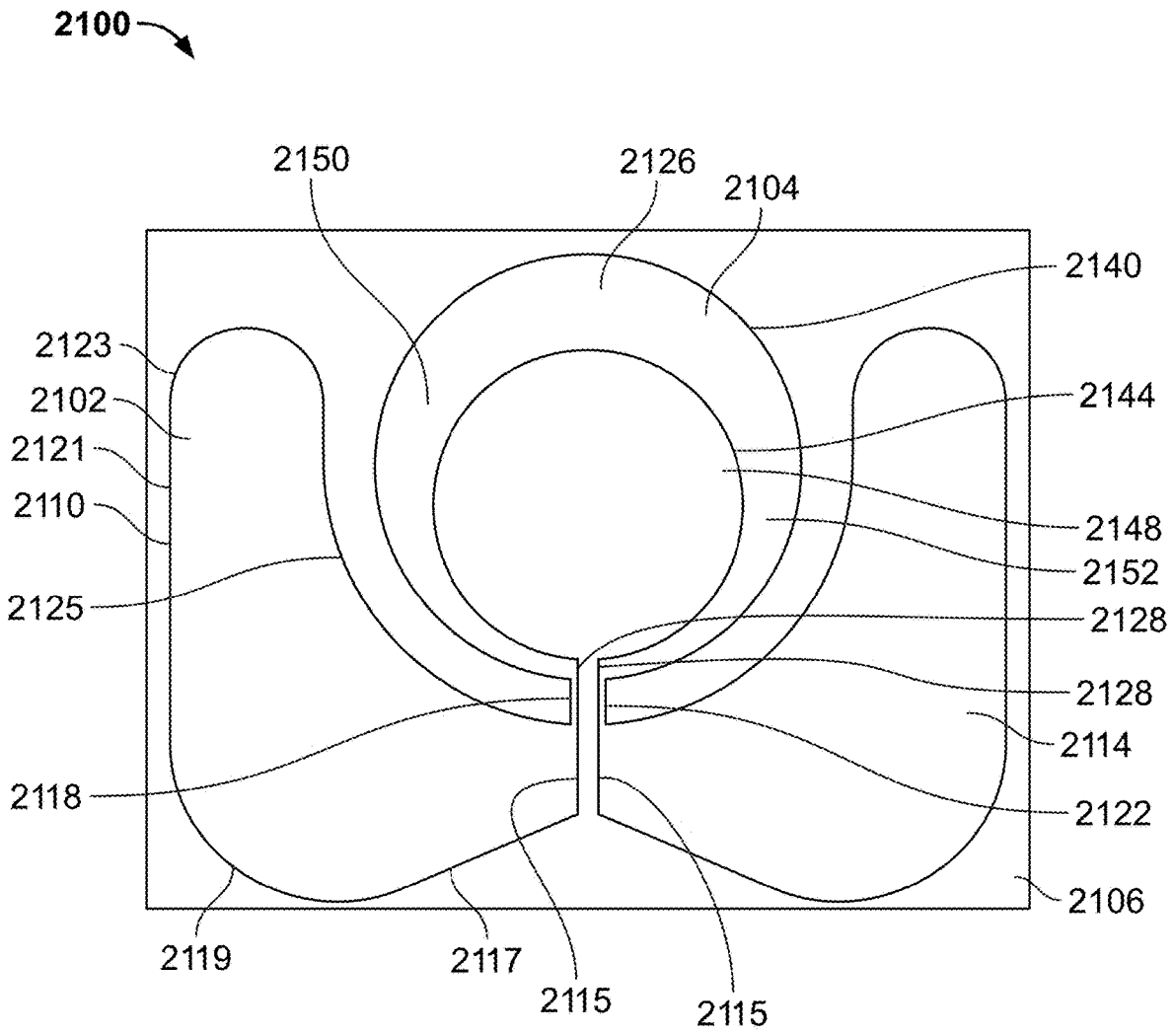

With reference now to the figures, FIG. 1 illustrates an exemplary embodiment of an HDTV antenna assembly 2100 embodying one or more aspects of the present disclosure. As shown, the antenna assembly 2100 includes a plurality of elements 2102 on a substrate 2106. The plurality of elements 2102 may be configured to cooperatively define a generally menorah shape (e.g., an upper portion of a menorah without the base, etc.) in which the element 2104 may represent a center starter candle and the elements 2110 and 2114 may respectively represent the outer four candles along each side of the center starter candle. The antenna assembly 2100 is operable for receiving VHF and UHF high definition television signals.

The plurality of elements 2102 include a first antenna element 2104 having a generally annular shape with an opening 2148 and spaced-apart first and second portions 2128. In this example embodiment, the antenna element 2104 comprises a tapered loop antenna element having a middle portion 2126 and first and second curved portions 2150, 2152. The first and second curved portions 2150, 2152 extend from the respective first and second end portions 2128 to the middle portion 2126 such that the antenna element's annular shape and opening 2148 are generally circular. The first and second curved portions 2150, 2152 may gradually increase in width from the respective first and second end portions 2128 to the middle or top portion 2126 such that the middle portion 2126 is wider than the first and second end portions 2128 and such that an outer diameter of the antenna element 2104 is offset from a diameter of the generally circular opening 2148. The first and second curved portions 2150, 2152 may be generally symmetric such that the first curved portion 2150 is a mirror-image of the second curved portion 2152. A center of the generally circular opening 2148 may be offset from a center of the generally circular annular shape of the antenna element 2104.

In addition, the plurality of elements may further include first and second arms 2110, 2114 (broadly, antenna elements) spaced apart from the antenna element 2104. The first and second arms 2110, 2114 extend at least partially along a bottom portion and respective first and second side portions of the antenna element 2104. In this example, the first and second arms 2110, 2114 are symmetric, and the first arm 2110 is a mirror-image of the second arm 2114.

Also in this example, each of the first and second arms 2110, 2114 includes an end portion 2115 and a downwardly slanted portion 2117 extending from the end portion 2115 of the respective first and second arms 2110, 2114. A first curved portion 2119 (e.g., a partial circular or elbow portion, etc.) is between and connects the downwardly slanted portion 2117 and an upwardly extending portion 2121. A curved free end portion 2123 (e.g., a semicircular portion, etc.) is between and connects the upwardly extending portion 2121 and a concave portion 2125 that extends to the end portion 2115 of the respective first and second arms 2110, 2114.

The antenna assembly 2100 also includes first and second connectors, connecting portions, or members 2118, 2122. The first member 2118 may extend downwardly between and connect the first arm 2110 and the first end portion 2128 of the antenna element 2104. The second member 2122 may extend downwardly between and connect the second arm 2114 and the second end portion 2128 of the antenna element 2104. The first and second members 2118, 2122 are spaced apart, linear, and parallel with each other in this example. The first and second members 2118 and 2122 provide a direct ohmic connection between the tapered loop antenna element 2104 and the respective first and second arms 2110 and 2114.

A single continuous open slot is defined by and extends at least partially between the spaced-apart first and second end portions 2128 of the antenna element 2104, the spaced-apart first and second members 2118, 2122, and the spaced-apart end portions 2115 of the respective first and second arms 2110, 2114. The open slot may be operable to provide a gap feed for use with a balanced transmission line. The high definition television antenna assembly 2100 may further comprise a balun (e.g., 2212 shown in FIG. 2, etc.) coupled to the first and second arms 2110, 2114 at an end of the open slot opposite the opening 2148 of the antenna element 2104. By way of example only, the balun may comprise a 75 Ohm 1:1 balun, and the antenna assembly 2100 may further comprise a connector (e.g., a type F Female connector, etc.) and a feed (e.g., a 75 ohm balanced input feed, etc.) to the element assembly. Also by way of example only, the antenna assembly 2100 may have a width of about 440 mm, a height of about 330 mm, and a depth of less than 15 mm depending on the connector type.

The natural impedance of the UHF tapered loop element 2104 alone may be about 300 ohms in the UHF band. The natural coupling of the tapered loop element to the larger menorah shaped VHF elements 2110, 2114 may cause the impedance of the plurality of elements 2102 (combined elements 2104, 2110, 2114) to drop into the range of about 75 ohms across both the high VHF and UHF HDTV bands. This allows the plurality of elements 2102 to be fed using a single 75 ohm to 75 ohm (1:1) balun and eliminates the need for a costly and lossy diplexer circuit as well as separate baluns for each of the UHF and VHF elements 2104, 2110, 2114.

With continued reference to FIG. 1, the substrate 2106 may support and/or be coupled to the antenna element 2104, the first and second arms 2110, 2114, and the first and second members 2118, 2122. The substrate 2106, the antenna element 2104, the first and second arms 2110, 2114, and the first and second members 2118, 2122 may be capable of being flexed, bent, or curved to have a radius of curvature of 300 millimeters or less.

A wide range of materials may be used for the antenna assembly 2100 and other antenna assemblies disclosed herein. In an exemplary embodiment, the substrate 2106 comprises FR4 composite material, silicone, polypropylene, plexiglass/polycarbonate, glass, or polyurethane rubber. An outer surface or covering may be provided to the antenna assembly 2100, which outer covering may comprise a naturally tacky or self-adherent material. With the naturally tacky or self-adherent properties, the outer covering may allow the antenna assembly 2100 to be mounted or attached directly to a window or other support surface without any additional adhesives needed between the window and the naturally tacky or self-adherent outer covering or surface of the antenna assembly 2100. Advantageously, mounting an antenna assembly to a window may provide a higher and more consistent HDTV signal strength as compared to interior locations of a home. An antenna assembly may be mounted on various window types, such as a single or double pane window that is partially frosted and does not include a low e-coating, etc.

The antenna element 2104, arms 2110, 2114, and members 2118, 2122 may comprise an electrically-conductive material (e.g., aluminum or copper foil, anodized aluminum, copper, stainless steel, other metals, other metal alloys, etc.). By way of example, the elements 2102 may be flat with a generally constant or uniform thickness and/or be stamped from metal (e.g., copper sheet metal, etc.). The elements 2102 may be etched on a PCB coated in copper or other suitable material (e.g., coated in one ounce of copper per square foot (equivalent to approximately 35 um thickness), etc.). Alternative embodiments may include a substrate and/or elements configured differently, e.g., that are curved, do not have a generally constant or uniform thickness, and/or formed from a different material and/or process besides stamped metal, etc. For example, the substrate 2106 may comprise a flexible polymer substrate, and the antenna element 2104, the first and second arms 2110, 2114, and the first and second members 2118, 2122 may comprise one or more thin flexible antenna elements made of electrically-conductive material sputtered on the flexible polymer substrate. As another example, the antenna element 2104, the first and second arms 2110, 2114, and the first and second members 2118, 2122 may comprise a single piece of electrically-conductive material (e.g., copper, etc.) having a monolithic construction. As a further example, the substrate 2106 may comprise a polyester substrate, and the antenna element 2104, the first and second arms 2110, 2114, and the first and second members 2118, 2122 may comprise electrically-conductive ink screen printed on the polyester substrate.

The back or rear surface(s) of the antenna assembly 2100 may be flat and planar. This, in turn, would allow the flat back surface to be positioned flush against a window. Accordingly, some exemplary embodiments of an antenna assembly do not include or necessarily need a support or mount having a base or stand for supporting or mounting the antenna assembly to a horizontal surface, to a vertical surface, or to a reflector and mounting post. In other exemplary embodiments, the antenna assembly 2100 may include a reflector and/or support having a base or stand. For example, the antenna assembly 2100 may include a dielectric center support.

In some exemplary embodiments, the substrate 2106, antenna element 2104, first and second arms 2110, 2114, and first and second members 2118, 2122 may have sufficient flexibility to be rolled up into a cylindrical or tubular shape and then placed into a tube, etc., to reduce shipping costs and decrease shelf space requirements, etc. In an exemplary embodiment, the antenna element 2104, first and second arms 2110, 2114, and first and second members 2118, 2122 may be adhered to a sticky silicone mat or substrate, which, in turn, could adhere to glass. In an exemplary embodiment, the substrate 2106 may comprise a flexible polymer substrate, and the antenna element 2104, the first and second arms 2110, 2114, and the first and second members 2118, 2122 may comprise one or more thin flexible antenna elements made of electrically-conductive material (e.g., metals, silver, gold, aluminum, copper, etc.) sputtered on the flexible polymer substrate. In another exemplary embodiment, the antenna element 2104, the first and second arms 2110, 2114, and the first and second members 2118, 2122 may comprise a single piece of electrically-conductive material (e.g., metals, silver, gold, aluminum, copper, etc.) having a monolithic construction. In still a further exemplary embodiment, the substrate 2106 may comprise a polyester substrate, and the antenna element 2104, the first and second arms 2110, 2114, and the first and second members 2118, 2122 may comprise electrically-conductive ink (e.g., silver, etc.) screen printed on the polyester substrate.

In some exemplary embodiments, an antenna assembly disclosed herein (e.g., antenna assembly 2100, etc.) may include an amplifier such that the antenna assembly is amplified. In other exemplary embodiments, the antenna assembly may be passive and not include any amplifiers for amplification.

As shown in FIG. 1, the antenna element 2104 has a generally annular shape cooperatively defined by an outer periphery or perimeter portion 2140 and an inner periphery or perimeter portion 2144. The outer periphery or perimeter portion 2140 is generally circular. The inner periphery or perimeter portion 2144 is also generally circular, such that the antenna element 2104 has a generally circular opening or thru-hole 2148. The inner diameter is offset from the outer diameter such that the center of the circle defined generally by the inner perimeter portion 2144 (the inner diameter's midpoint) is below (e.g., about twenty millimeters, etc.) the center of the circle defined generally by the outer perimeter portion 2140 (the outer diameter's midpoint). The offsetting of the diameters thus provides a taper to the antenna element 2104 such that it has at least one portion (a top portion 2126 shown in FIG. 1) wider than another portion, e.g., the end portions 2128.

In exemplary embodiments, the opening or area 2148 is not a thru-hole as there is a portion of substrate under the opening 2148. In other exemplary embodiments, the opening 2148 is a thru-hole without any material within or under the opening 2148.

The antenna assembly 2100 may be positioned against a vertical window in an orientation such that the wider portion 2126 of the antenna element 2104 is at the top and the narrower end portions 2128 are at the bottom, to produce or receive horizontal polarization. For example, the vertical polarization can be received with 90 degree rotation about a center axis perpendicular to the plane of the loop of the antenna element 2104.

Figure 2:
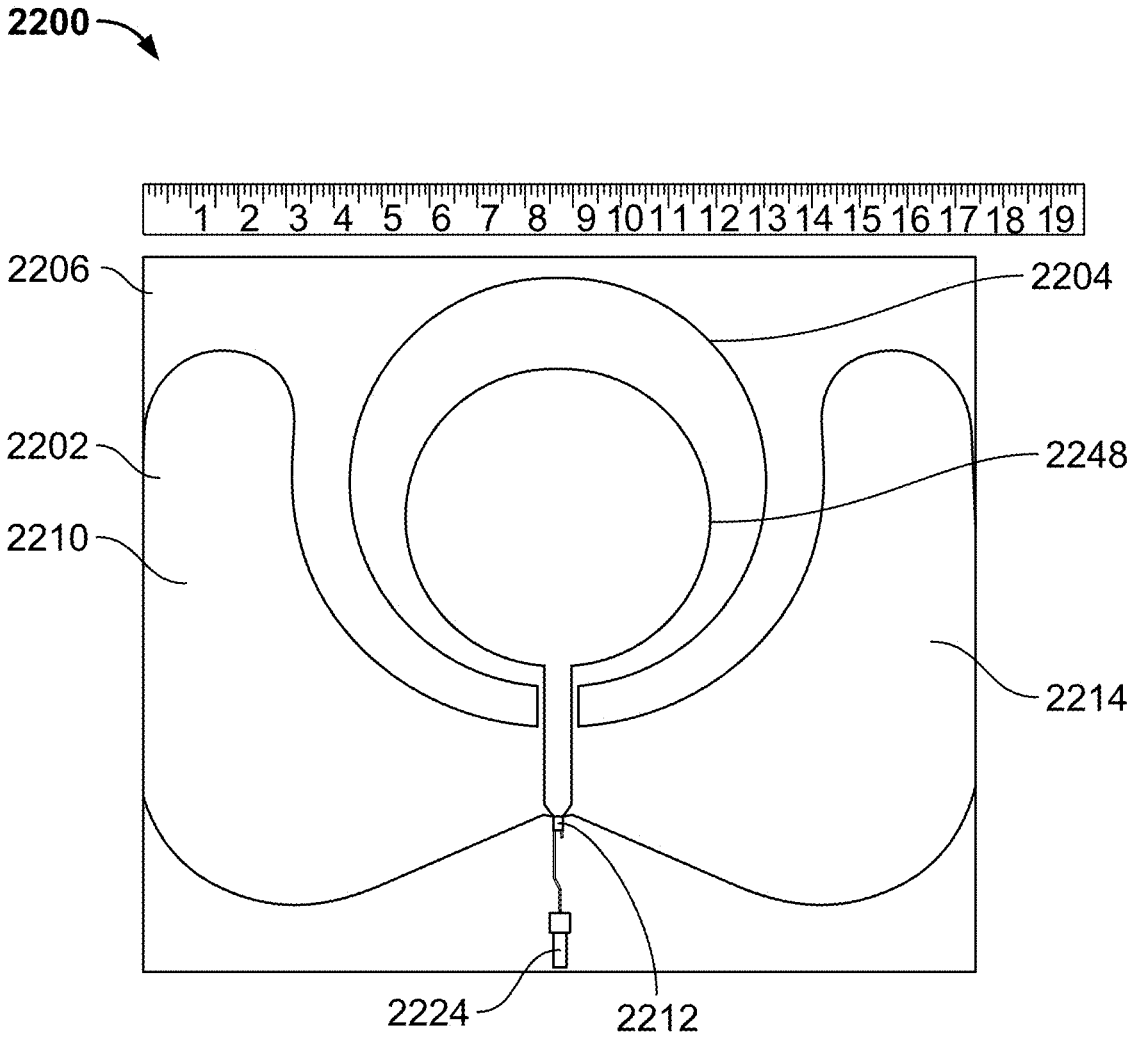

FIG. 2 illustrates another exemplary embodiment of an antenna assembly 2200 embodying one or more aspects of the present disclosure. As shown, the antenna assembly 2200 includes a plurality of elements 2202 on a substrate 2206. The plurality of elements 2202 may be configured to cooperatively define a generally menorah shape (e.g., an upper portion of a menorah without the base, etc.) in which the element 2104 may represent a center starter candle and the elements 2110 and 2114 may respectively represent the outer four candles along each side of the center starter candle. The antenna assembly 2200 is operable for receiving VHF and UHF high definition television signals.

The antenna assembly 2200 may be similar in structure and operation as the antenna assembly 2100 shown in FIG. 1 and described above. In this exemplary embodiment, a balun 2212 is shown coupled to the first and second arms 2210, 2214 at an end of the open slot opposite the opening of the antenna element 2204. By way of example only, the balun 2212 may comprise a 75 Ohm 1:1 balun. Also shown in FIG. 2 is a connector 2224 (e.g., a type F Female connector, etc.) and a feed (e.g., a 75 ohm balanced input feed to the elements, etc.). The connector 2224 may be connected to a coaxial cable (e.g., a 75-ohm RG6 coaxial cable fitted with an F-Type Male connector, etc.), which is then used for transmitting signals received by the antenna assembly 2200 to a television, etc. In this example, the antenna elements 2202 may have a natural impedance of about 75 ohms if fed from a balanced line, such as a 75 ohm twin lead. Because 75 ohm twin lead are uncommon, this example includes a 75 ohm to 75 ohm (1:1) balun in order to enable the use of a standard 75 ohm coaxial cable. Coax is an unbalanced line. In this example, the 1:1 balun is only sorting out the conversion from an unbalanced line (coaxial cable) to a balanced line required at the antenna feed point. Accordingly, the balun is not performing any impedance transformation in this example. Alternative embodiments may include other connectors, coaxial cables, or other suitable communication links.

Figure 3:
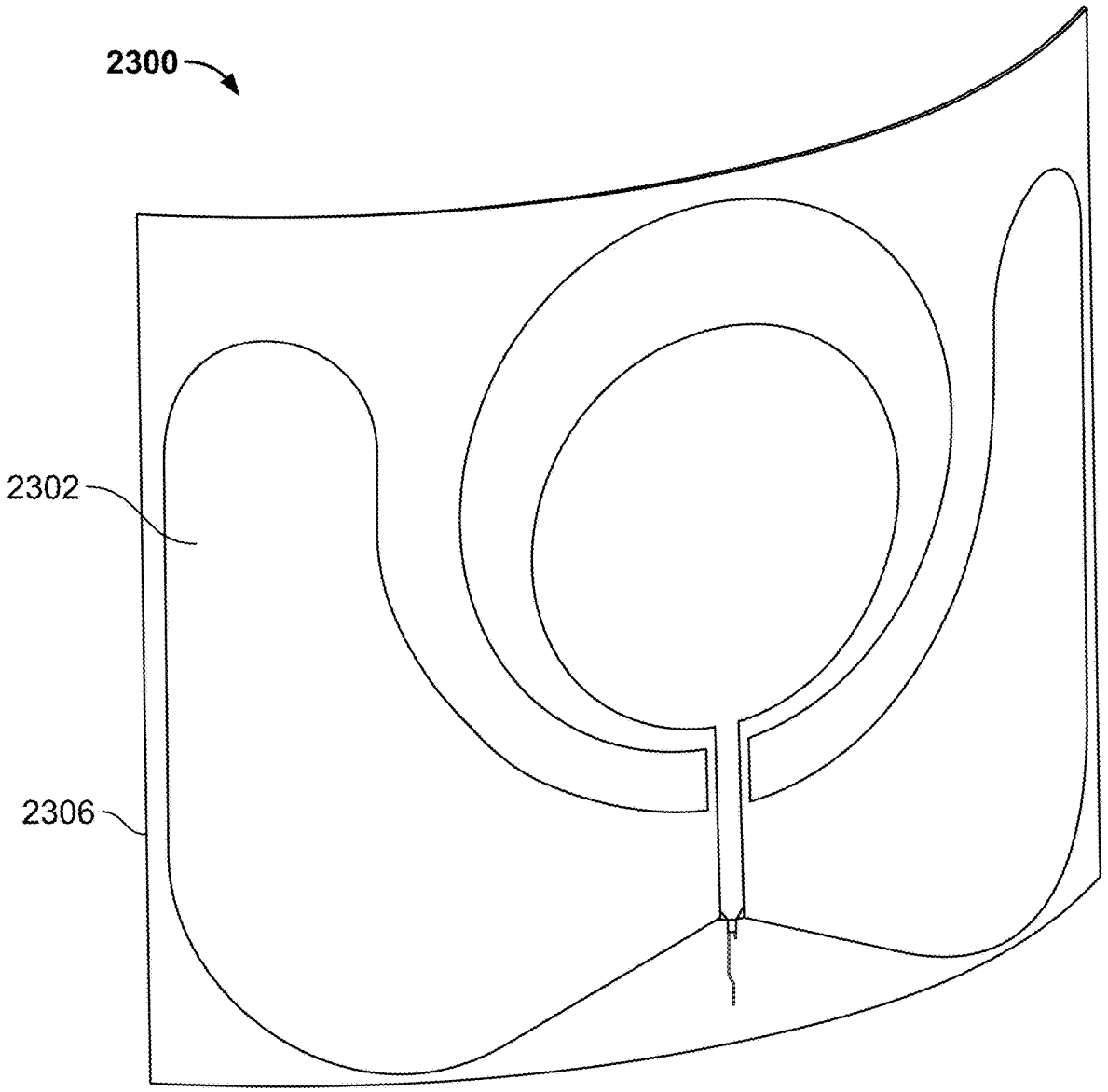
FIG. 3 illustrates an HDTV antenna assembly including antenna elements on a substrate having a radius of curvature of 300 millimeters (mm) according to an exemplary embodiment.
Figure 4:
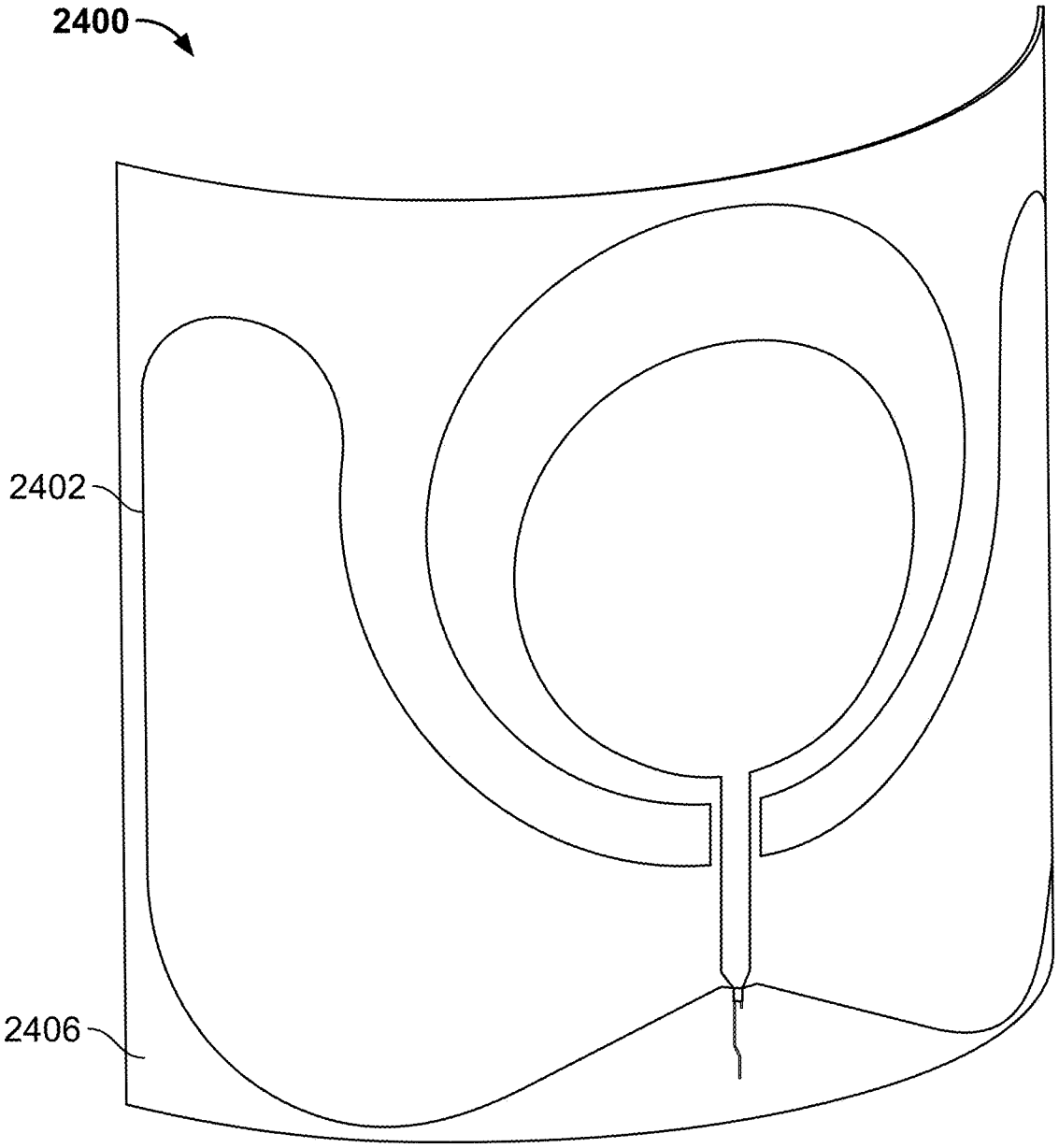
FIG. 4 illustrates an HDTV antenna assembly including antenna elements on a substrate having a radius of curvature of 200 mm according to an exemplary embodiment.
Figure 5:
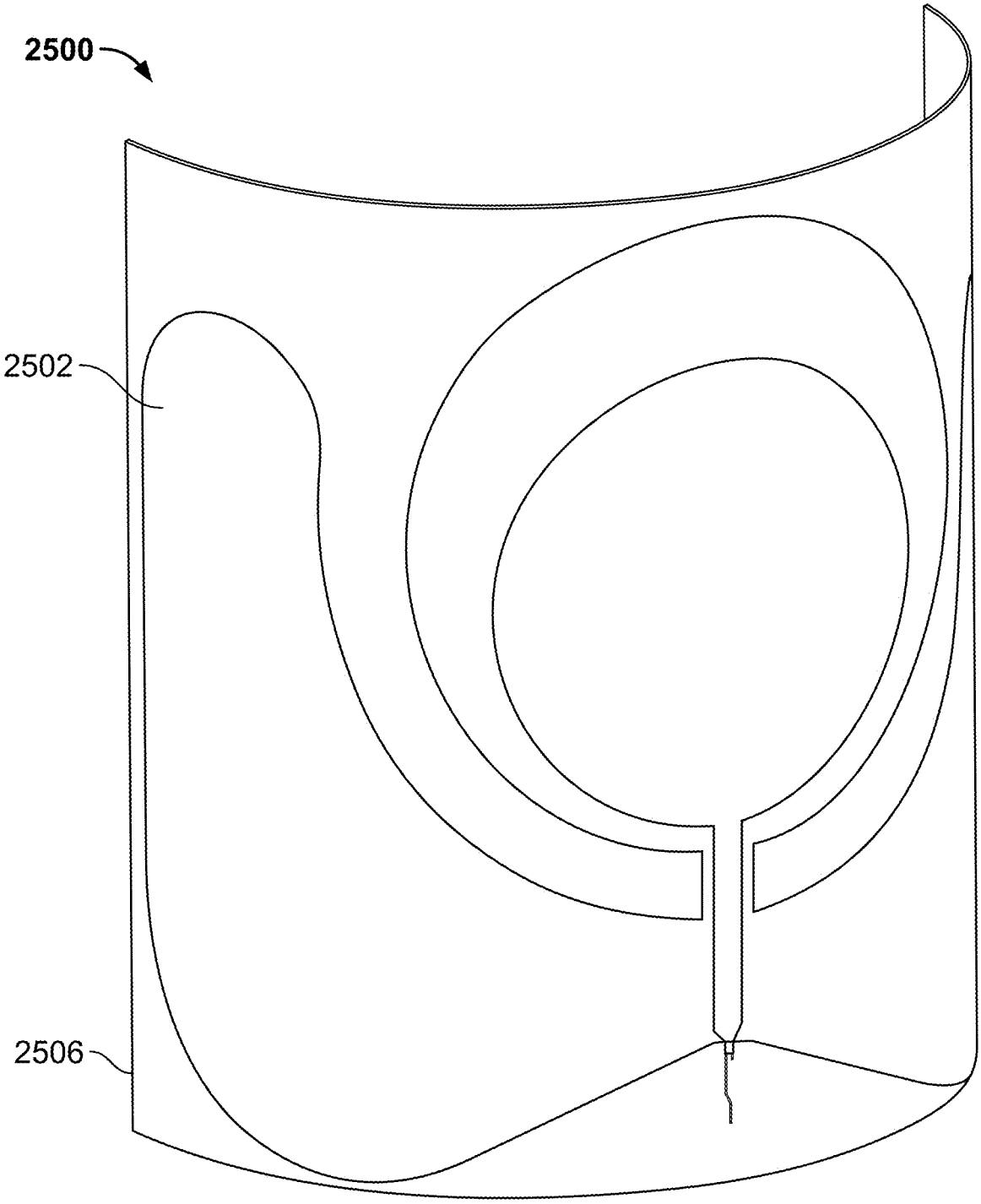
FIG. 5 illustrates an HDTV antenna assembly including antenna elements on a substrate having a radius of curvature of 150 mm according to an exemplary embodiment.
Figure 6:
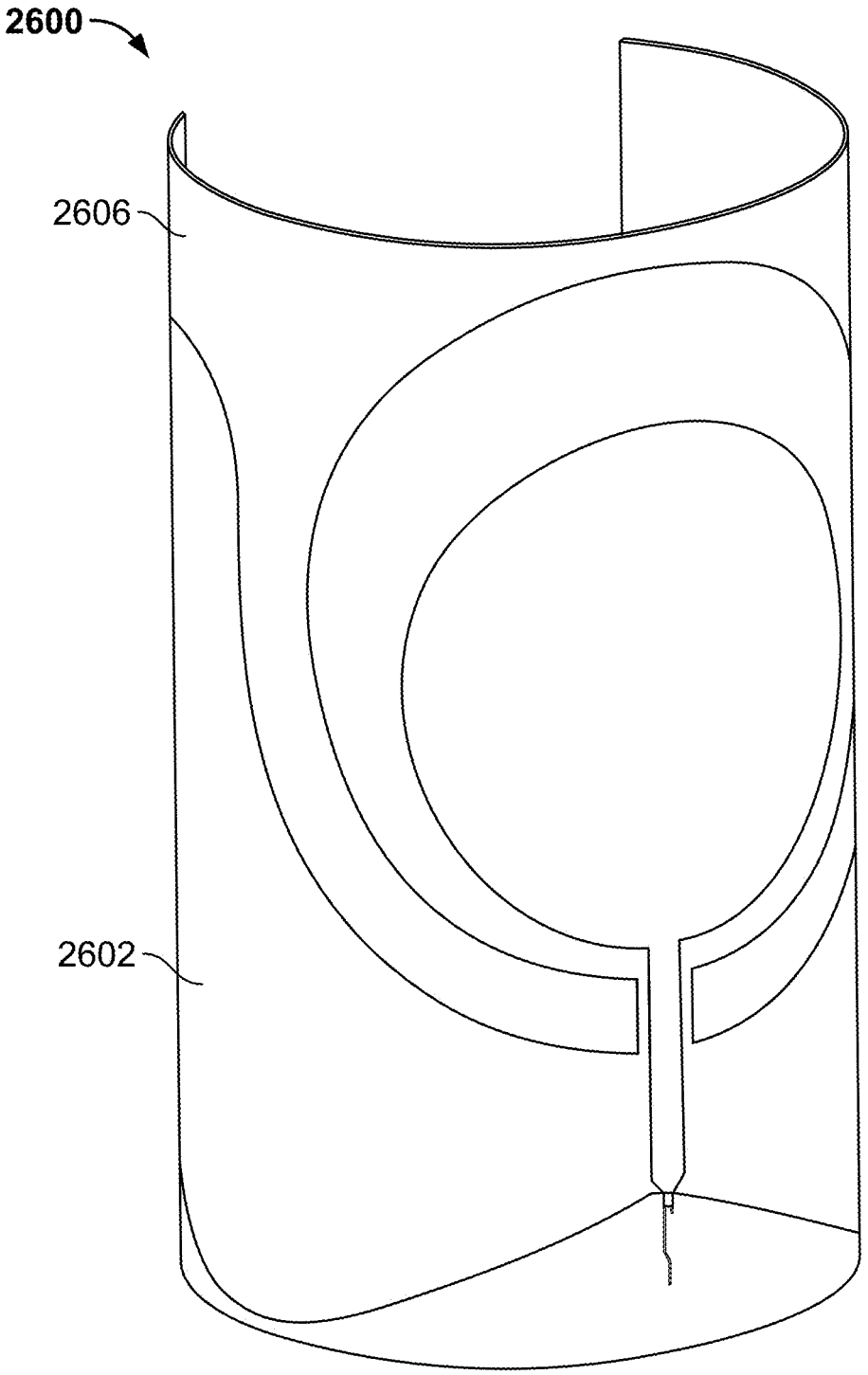
FIG. 6 illustrates an HDTV antenna assembly including antenna elements on a substrate having a radius of curvature of 100 mm according to an exemplary embodiment.
Figure 7:
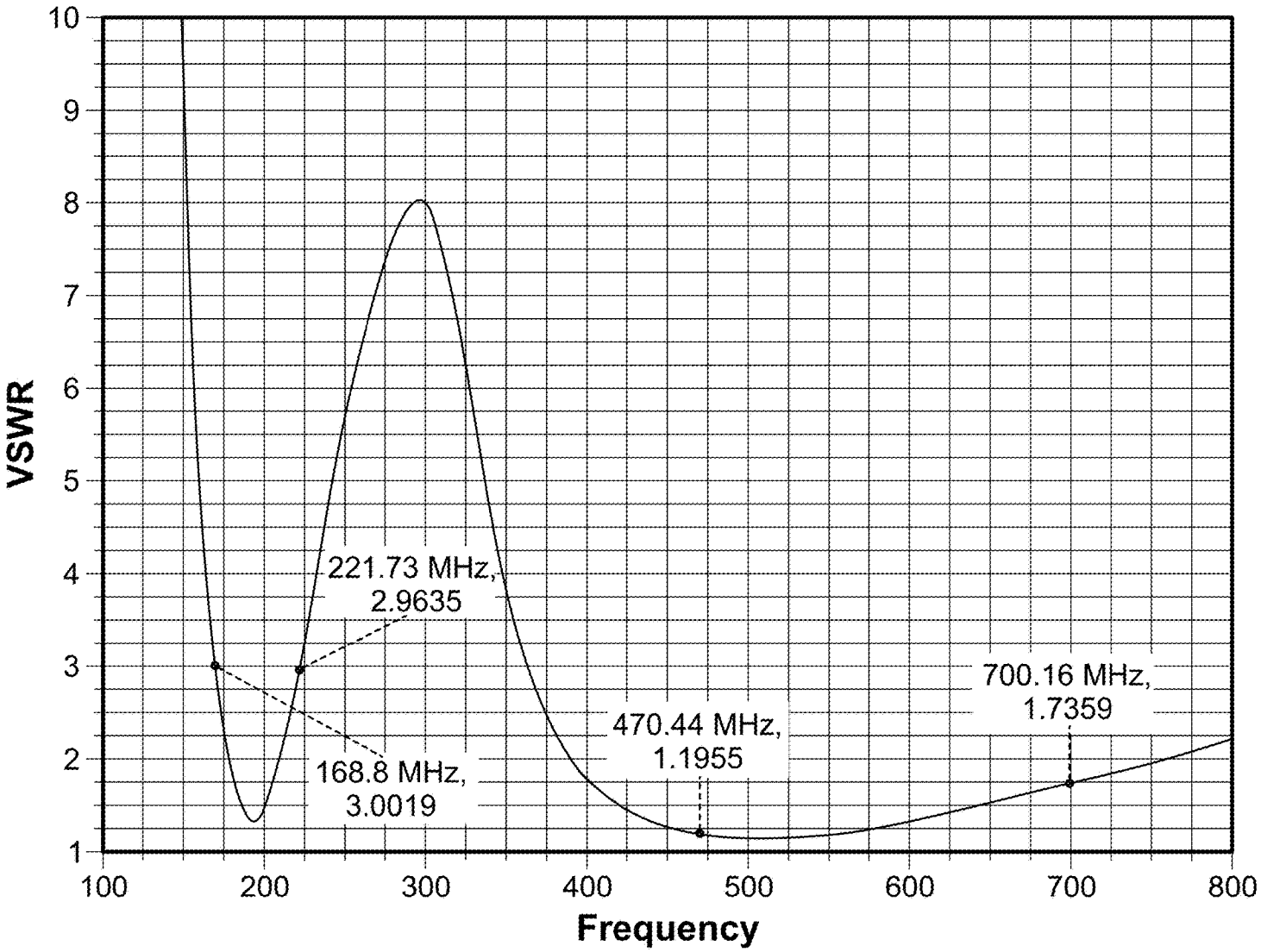
FIG. 7 is an exemplary line graph showing computer-simulated results of VSWR (voltage standing wave ratio) versus frequency (in megahertz) for the HDTV antenna assembly shown in FIG. 2.
Figure 8:
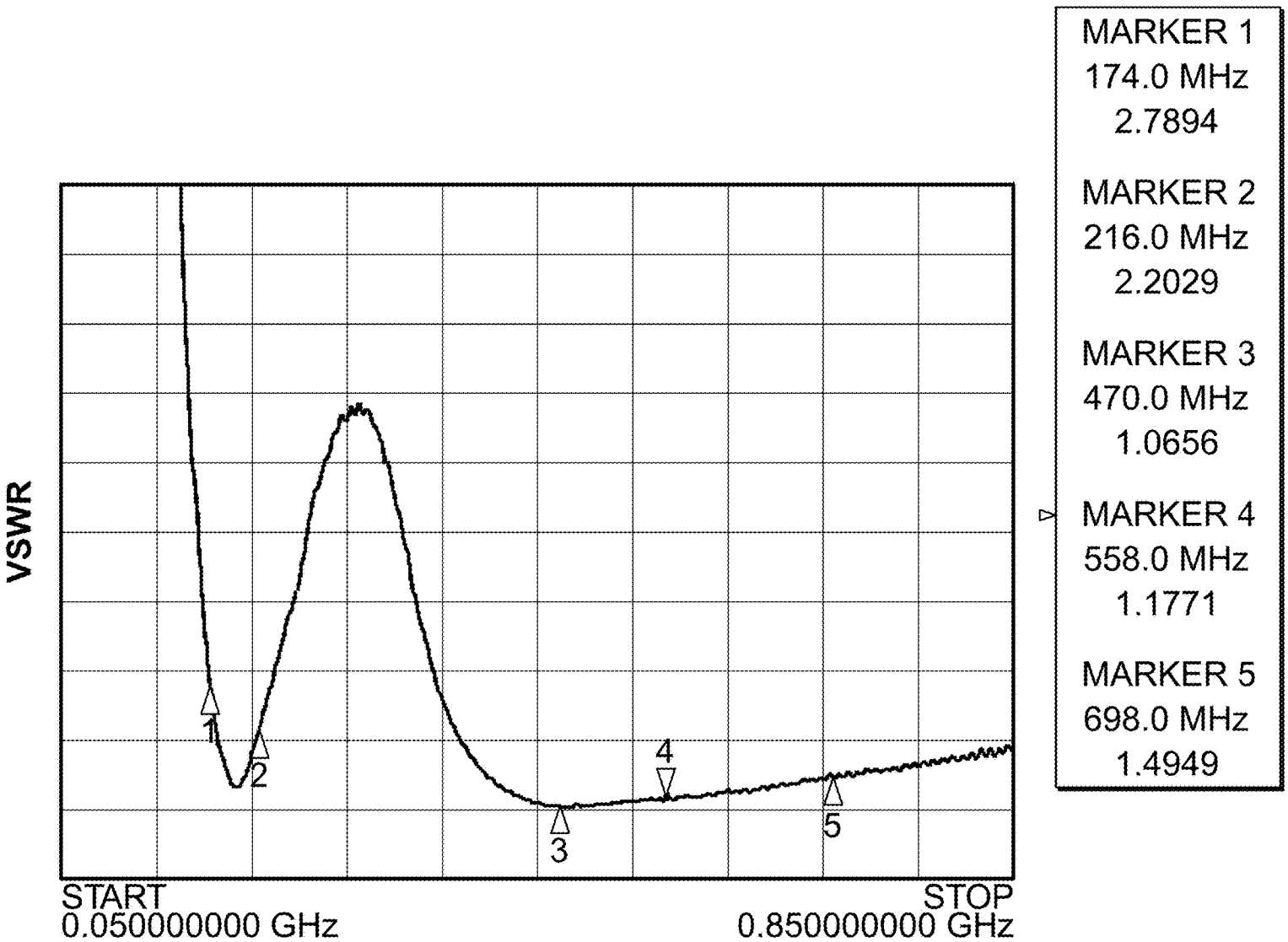
FIG. 8 is an exemplary line graph showing VSWR versus frequency measured for the prototype antenna assembly shown in FIG. 2 where the antenna elements were etched on a PCB coated in one ounce of copper per square foot (equivalent to approximately 35 um thickness)
Figure 9:
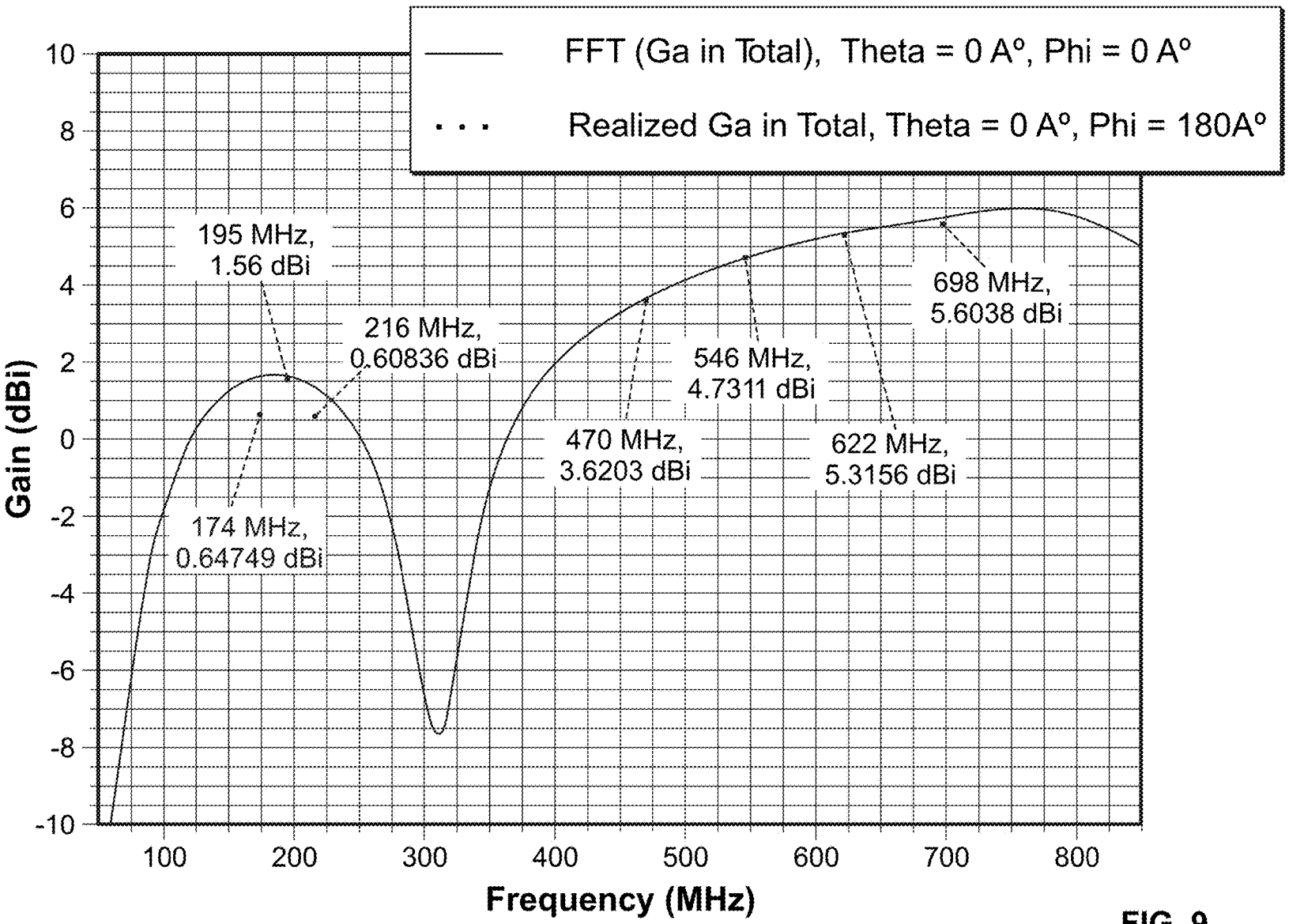
FIG. 9 is an exemplary line graph showing computer-simulated results of gain (in dBi) versus frequency (in megahertz) for the antenna assembly shown in FIG. 2.
Figure 10:
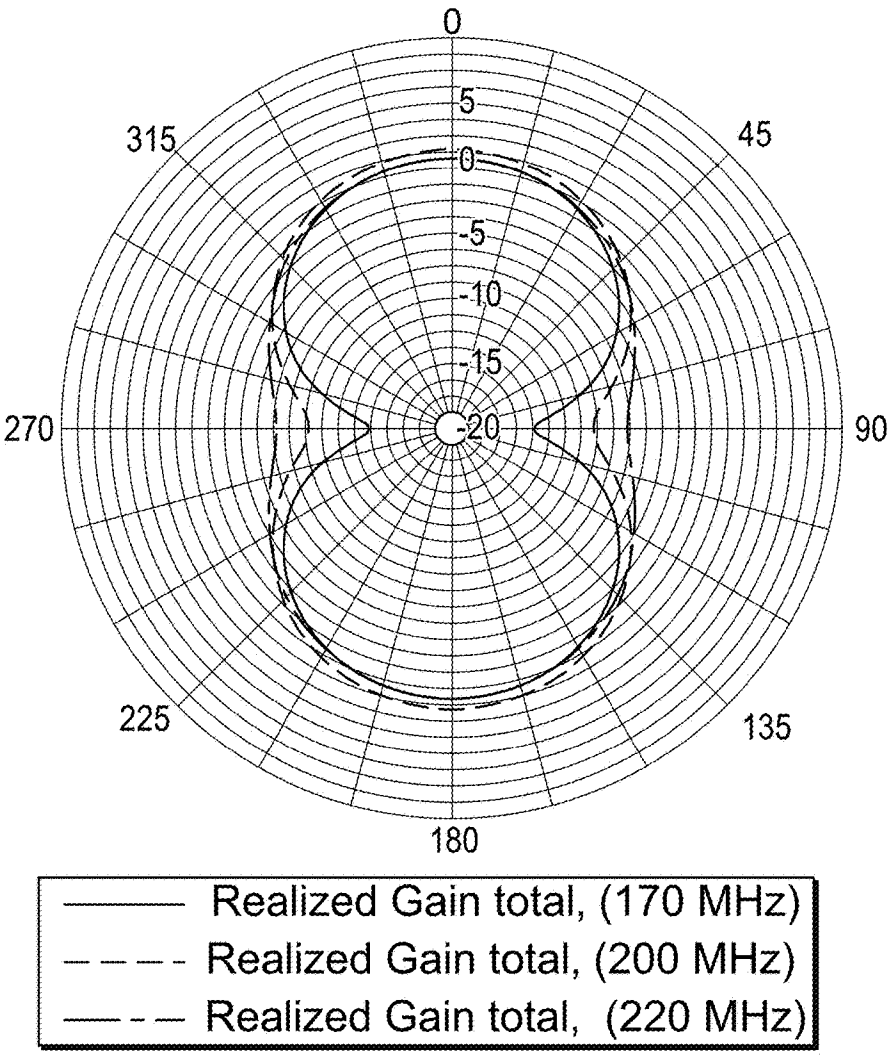
FIG. 10 is an exemplary graph showing computer-simulated results of VHF horizontal plane realized gain versus Theta at frequencies of 170 MHz, 200 MHz, and 220 MHz for the antenna assembly shown in FIG. 2.
Figure 11:
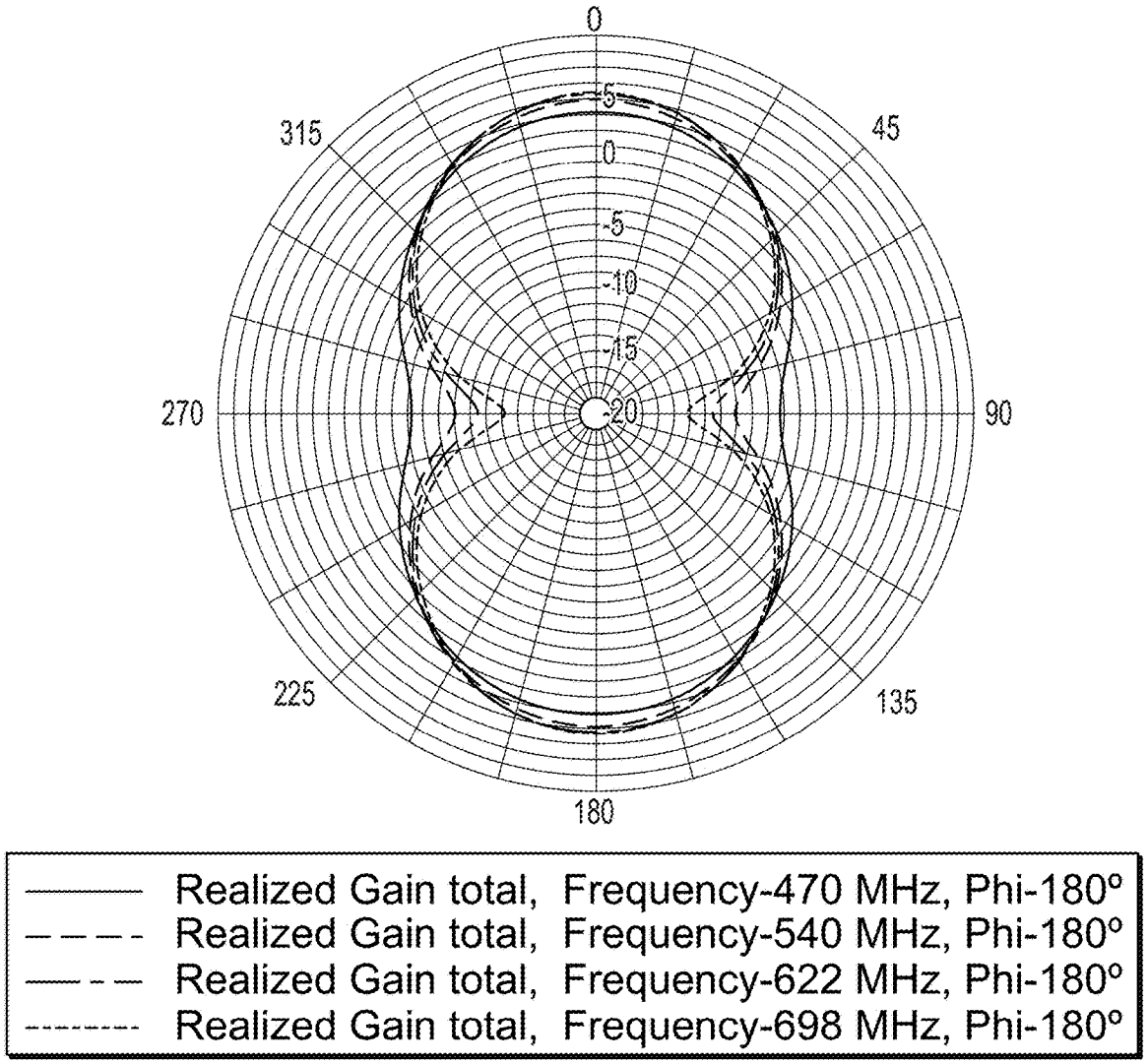
FIG. 11 is an exemplary graph showing computer-simulated results of UHF horizontal plane realized gain versus Theta at frequencies of 470 MHz, 546 MHz, 622 MHz, and 698 MHz with Phi=180° for the antenna assembly shown in FIG. 2.
Figure 12:
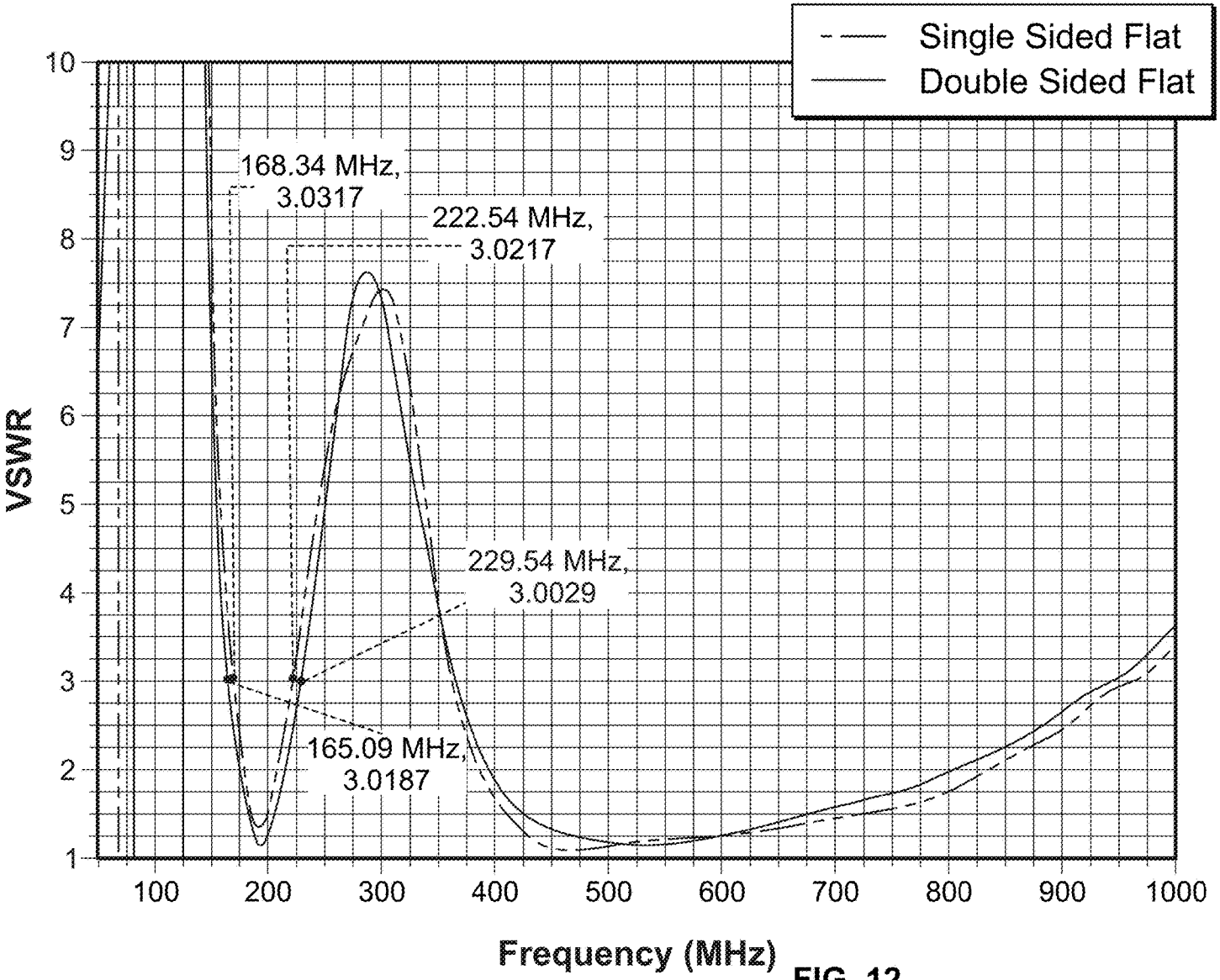
FIG. 12 is an exemplary line graph showing computer-simulated results of VSWR versus frequency (in megahertz) for a single sided antenna assembly (with the elements shown in FIG. 3 along only one side of a planar or flat substrate) and for a double sided antenna assembly (with the antenna elements shown in FIG. 3 along both sides of a planar or flat substrate)
Figure 13:
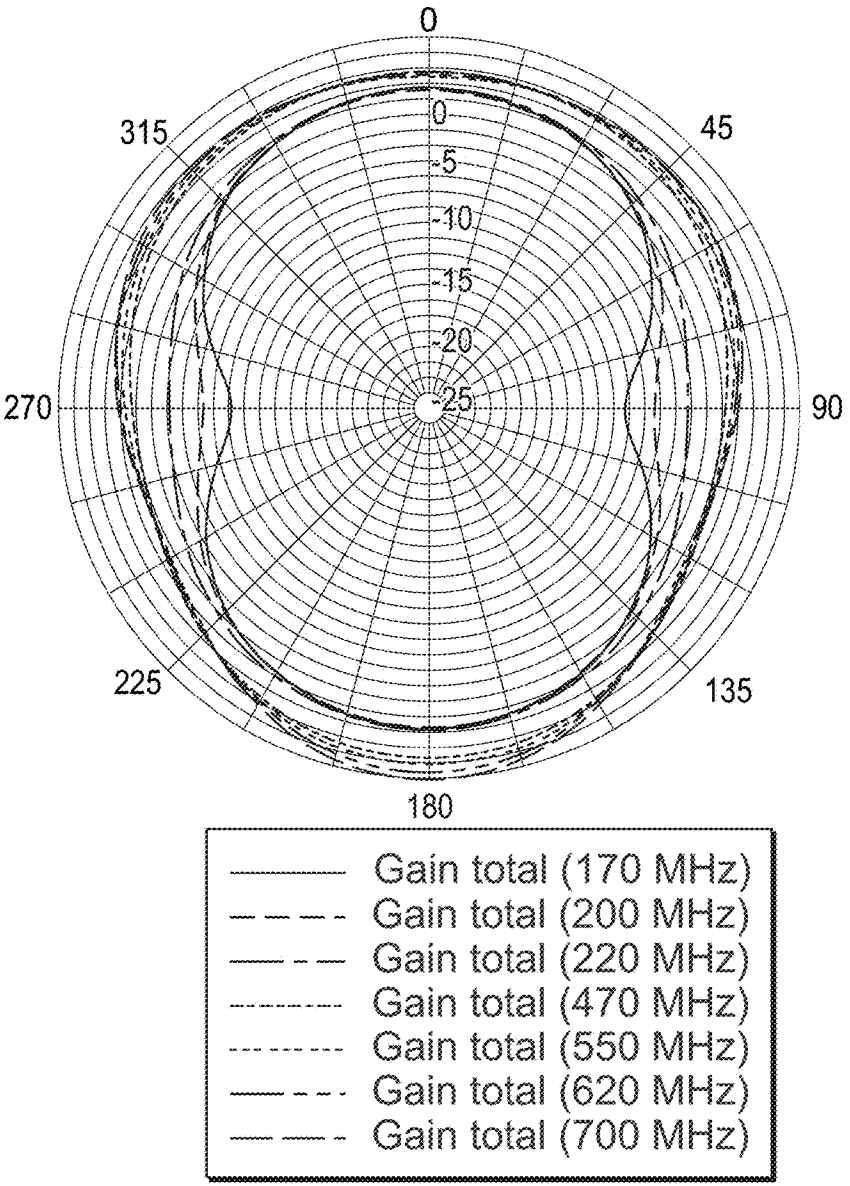
FIG. 13 is an exemplary line graph showing computer-simulated results of gain versus Theta at frequencies of 170 MHz, 200 MHz, 220 MHz, 470 MHz, 550 MHz, 620 MHz, and 700 MHz for the antenna assembly shown in FIG. 5 with a radius of curvature of 150 mm.

In exemplary embodiments, the substrate and antenna elements thereon (e.g., tapered loop antenna element, first and second arms, and first and second connectors or members) may be sufficiently flexibility to be flexed, bent, or curved to a radius of curvature of 300 millimeters (mm) or less. For example, FIG. 3 illustrates an exemplary embodiment of an HDTV antenna assembly 2300 including antenna elements 2302 on a substrate 2306, where the antenna elements 2302 and substrate 2306 are curved to have a radius of curvature of 300 mm. FIG. 4 illustrates an exemplary embodiment of an HDTV antenna assembly 2400 including antenna elements 2402 on a substrate 2406, where the antenna elements 2402 and substrate 2406 are curved to have a radius of curvature of 200 mm. FIG. 5 illustrates an exemplary embodiment of an HDTV antenna assembly 2500 including antenna elements 2502 on a substrate 2506, where the antenna elements 2502 and substrate 2506 are curved to have a radius of curvature of 150 mm. FIG. 6 illustrates an exemplary embodiment of an HDTV antenna assembly 2600 including antenna elements 2602 on a substrate 2606, where the antenna elements 2602 and substrate 2606 are curved to have a radius of curvature of 100 mm.

The dimensions provided in the above paragraph (as are all dimensions set forth herein) are mere examples provided for purposes of illustration only, as any of the disclosed antenna components herein may be configured with different dimensions depending, for example, on the particular application and/or signals to be received or transmitted by the antenna assembly. For example, another exemplary embodiment may include an antenna element on a substrate, where the antenna element and substrate are curved to have a radius of curvature different than what is shown in FIGS. 3, 4, 5, and 6, such as a radius of curvature less than 100 mm, a radius of curvature greater than 300 mm, a radius of curvature within a range from 100 mm to 150 mm, from 100 mm to 200 mm, from 100 mm to 300 mm, from 150 to 200 mm, from 150 to 300 mm, from 200 mm to 300 mm, etc. Or, for example, another exemplary embodiment may include an antenna element on a substrate, where the antenna element and substrate are flat without any radius of curvature (e.g., HDTV antenna assembly 2100 shown in FIG. 1, HDTV antenna assembly 2200 shown in FIG. 2, etc.) or curved to have a radius of curvature.

In exemplary embodiments in which an antenna assembly (e.g., 2100, 2200, 2300, 2400, 2500, etc.) includes a substrate (e.g., 2106, 2206, 2306, 2406, 2506, etc.) for adherence to a window or other glass surface, the substrate may comprise polyurethane rubber material that is relatively soft and sticky. In an exemplary embodiment, the substrate comprises an adhesive polyurethane soft rubber. The substrate may initially include top and bottom outermost, removable liners made of polyethylene terephthalate (PET) film. The top liner may be disposed directly on the adhesive polyurethane soft rubber in order to prevent dust and debris from adhering to the adhesive polyurethane soft rubber. The top liner may be removed when the antenna assembly is to be adhered to a window via the adhesive polyurethane soft rubber. The bottom liner may be removed to expose an acrylic adhesive for adhering the substrate to the back of the antenna assembly. The substrate may also include a carrier (e.g., PET film, etc.) on the bottom of the adhesive polyurethane soft rubber. The acrylic adhesive may be coated on the opposing surfaces of the bottom liner and carrier, respectively. The substrate, in this example, may be transparent in color and/or have a total thickness of about 3 millimeters.

Figure 14:
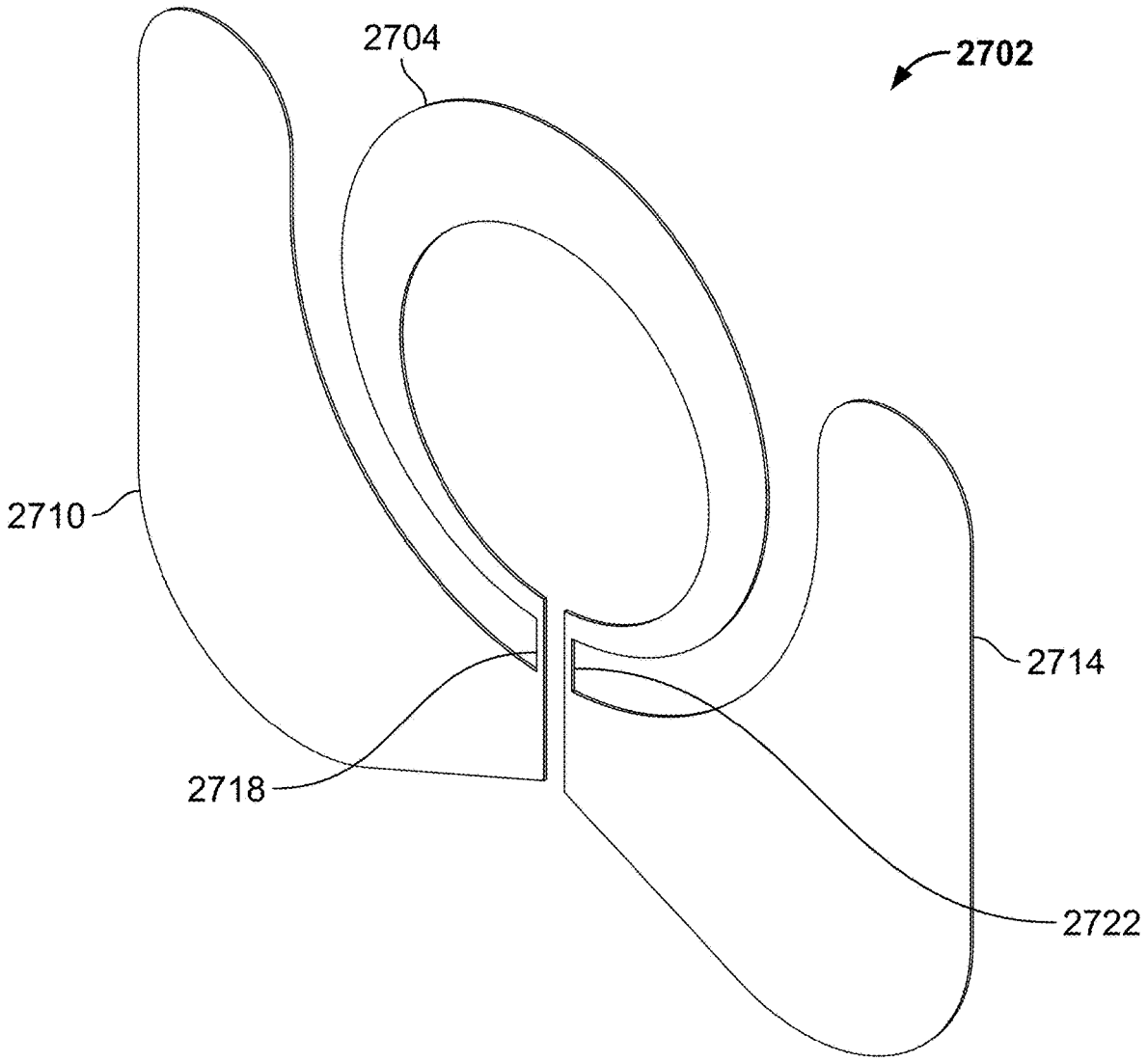
FIG. 14 is a perspective view of UHF and VHF antenna elements according to an exemplary embodiment in which the UHF and VHF antenna elements are not shown on a substrate.
Figure 15:
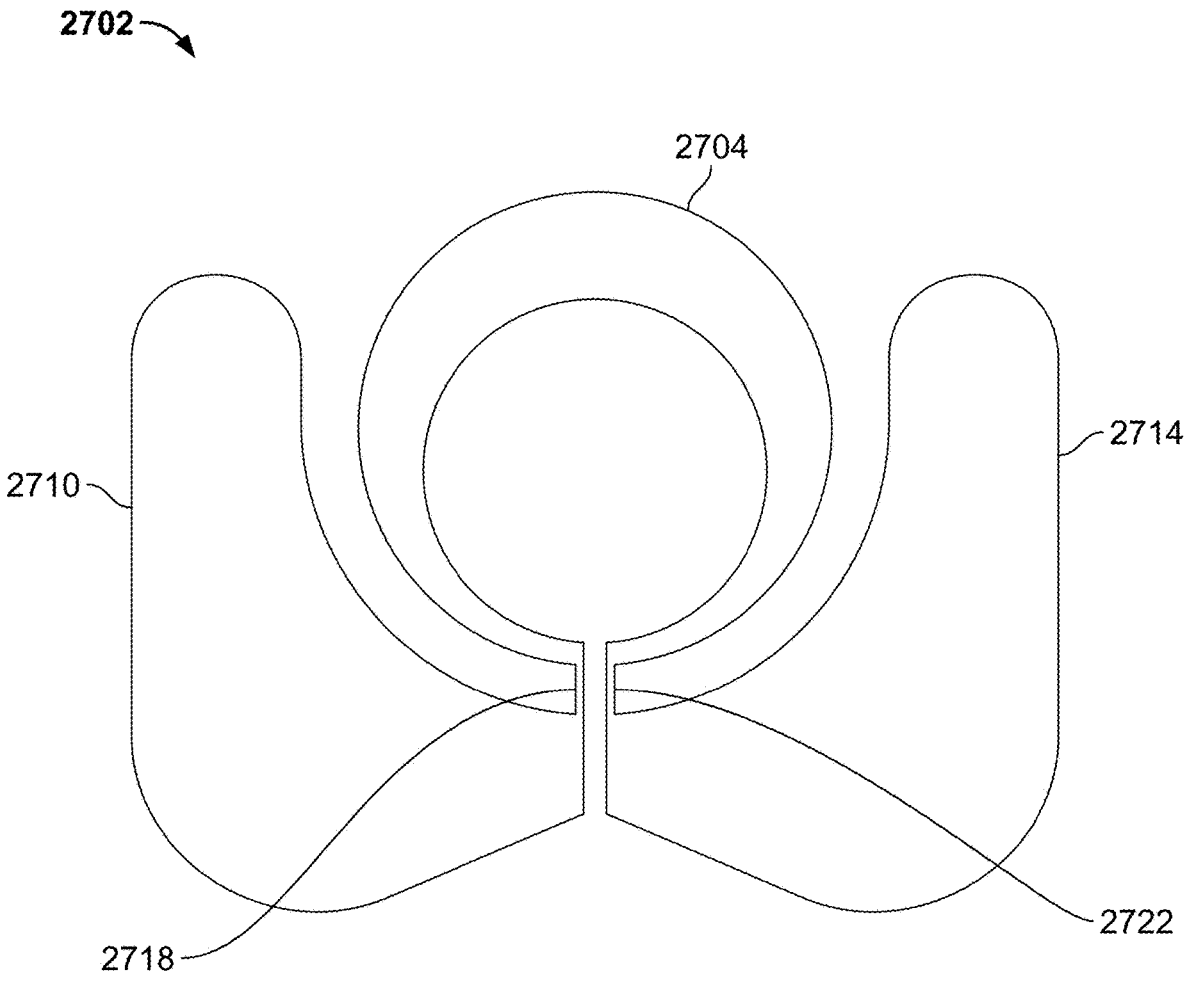
FIG. 15 is a front view of the antenna elements shown in FIG. 14.

By way of further example, other exemplary embodiments may include antenna elements without any substrate. For example, FIGS. 14 and 15 illustrate antenna elements 2702 without any substrate according to an exemplary embodiment. The antenna elements 2702 may be identical or similar in structure and operation as the antenna elements 2102 shown in FIG. 1 and described above. For example, the antenna elements 2702 may include a first antenna element 2704 comprising a tapered loop antenna element identical or similar in structure and operation as the tapered loop antenna element 2704. The antenna elements 2702 may further include first and second arms 2710, 2714 identical or similar in structure and operation as the first and second arms 2110, 2114.

As shown in FIGS. 14 and 15, the antenna elements 2702 may be configured to cooperatively define a generally menorah shape (e.g., an upper portion of a menorah without the base, etc.) in which the UHF tapered loop antenna element 2704 may represent a center starter candle and the VHF elements 2710, 2714 may respectively represent the outer four candles along each side of the center starter candle. The antenna elements 2702 may be operable for receiving VHF and UHF high definition television signals.

First and second connectors, connecting portions, or members 2718, 2722 extend downwardly between and connect the respective first and second arms 2710, 2714 to the tapered loop antenna element 2704. The first and second members 2718, 2722 are spaced apart, linear, and parallel with each other in this example. The first and second members 2718 and 2722 provide a direct ohmic connection between the tapered loop antenna element 2704 and the respective first and second arms 2710 and 2714.

FIGS. 16 and 17 illustrate antenna elements 2802 according to another exemplary embodiment in which the first or UHF antenna element 2804 and the second or VHF antenna element 2810 are electromagnetically coupled without a direct ohmic connection between the UHF and VHF antenna element 2804 and 2810. Also in this exemplary embodiment, the VHF antenna element 2810 comprises a single piece element having a monolithic construction without any slot separating the VHF antenna element 2810 into first and second spaced apart elements.

As shown in FIGS. 16 and 17, the antenna elements 2802 may be configured to cooperatively define a generally menorah shape (e.g., an upper portion of a menorah without the base, etc.) in which the UHF antenna element 2804 may represent a center starter candle and the first and second arms or portions of the VHF element 2810 may respectively represent the outer four candles along each side of the center starter candle. The antenna elements 2802 may be operable for receiving VHF and UHF high definition television signals.

The UHF antenna element 2804 has a generally annular shape with an opening 2848, spaced-apart first and second portions 2828, a middle portion 2826, and first and second curved portions 2850, 2852. The first and second curved portions 2850, 2852 extend from the respective first and second end portions 2828 to the middle portion 2826 such that the antenna element's annular shape and opening 2848 are generally circular. The first and second curved portions 2850, 2852 may gradually increase in width from the respective first and second end portions 2828 to the middle or top portion 2826 such that the middle portion 2826 is wider than the first and second end portions 2828 and such that an outer diameter of the antenna element 2804 is offset from a diameter of the generally circular opening 2848. The first and second curved portions 2850, 2852 may be generally symmetric such that the first curved portion 2850 is a mirror-image of the second curved portion 2852. A center of the generally circular opening 2848 may be offset from a center of the generally circular annular shape of the antenna element 2804.

The VHF antenna element 2810 includes first and second arms or portions spaced apart from the UHF antenna element 2804. The first and second arms extend at least partially along a bottom portion and respective first and second side portions of the antenna element 2804. In this example, the first and second arms are symmetric, and the first arm is a mirror-image of the second arm.

Also in this example, the VHF antenna element 2810 includes a generally flat or linear bottom portion 2817 and first and second upwardly extending portions 2821 along opposite sides of the VHF antenna element 2810. The first and second upwardly extending portions 2821 are generally perpendicular to the bottom portion 2817. The VHF antenna element 2810 includes first and second rounded or curved free end portions 2823 between and connecting the corresponding first and second upwardly extending portion 2821 and corresponding first and second concave portions 2825. The concave portions 2825 extend from the end portions 2823 and curve generally under the UHF antenna element 2804.

A single continuous open slot is defined by and extends at least partially between the spaced-apart first and second end portions 2828 of the antenna element 2804. The open slot may be operable to provide a gap feed for use with a balanced transmission line. By way of example, a balun (e.g., 2812 shown in FIGS. 18 through 24, etc.) may be coupled to the antenna element 2804 at an end of the open slot of the antenna element 2804. By way of example only, the balun may comprise a 75 to 300 Ohm balun. The 300 ohm balanced side of the balun is connected to the antenna element and the 75 ohm unbalanced side is connected to a type F Female connector to facilitate connection to a 75 ohm coaxial cable.

In this example embodiment, the direct ohmic connection between the elements 2804, 2810 is removed and the VHF response is achieved by an electromagnetic coupling of the UHF tapered loop antenna element 2804 to the VHF antenna element 2810. This combination yields a dual band performance similar to the antenna assembly 2100 (FIG. 1) but with the advantage that the size of the VHF antenna element is considerably reduced in size. For example, the VHF antenna element 2810 may have an overall width of about 400 millimeters (about 15.75 inches) and an overall height of about 270 millimeters in an exemplary embodiment. By comparison, FIG. 2 shows that the overall width of the VHF antenna elements 2810, 2814 is about 17.5 inches. The UHF tapered loop antenna element 2804 may be similarly sized as the tapered loop antenna 2804 shown in FIG. 2. The dimensions provided in this paragraph (as are all dimensions set forth herein) are mere examples provided for purposes of illustration only, as any of the disclosed antenna components herein may be configured with different dimensions depending, for example, on the particular application and/or signals to be received or transmitted by the antenna assembly.

The vertical positioning of the UHF tapered loop antenna element 2804 relative to the VHF antenna element 2810 may be adjusted to effect changes in the electromagnetic coupling, and thus cause some change to the pass bands. The configuration shown in FIGS. 16 and 17 provides a good balance of VHF VSWR bandwidth while keeping VSWR in UHF relatively low. If the UHF tapered loop antenna element 2804 is positioned too close to the VHF antenna element 2810, then the UHF may suffer. But if the UHF tapered loop antenna element 2804 is positioned too far away from the VHF antenna element 2810, the electromagnetic coupling may then be too weak to provide good VHF.

FIGS. 18 and 19 illustrate an exemplary embodiment of an HDTV antenna assembly 2800 embodying one or more aspects of the present disclosure. As shown, the antenna assembly 2800 includes the UHF antenna element 2804 and VHF antenna element 2810 shown in FIGS. 16 and 17 on a substrate 2806. The substrate 2806 may support and/or be coupled to the UHF and VHF antenna elements 2804, 2810. For example, the UHF antenna element 2804 may include openings for receiving posts or fasteners extending from the substrate 2806 to align, position, and couple the UHF antenna element 2804 to the substrate 2806 and balun 2812. The substrate 2806 and the UHF and VHF antenna elements 2804, 2810 may be capable of being flexed, bent, curved, or rolled up, e.g., to have a radius of curvature of 300 millimeters or less, etc.

A balun 2812 is coupled to the UHF antenna element 2804 at an end of the open slot of the UHF antenna element 2804. The balun 2812 and substrate 2806 are also shown in FIGS. 20 through 24. By way of example only, the balun 2812 may comprise a 75 to 300 Ohm balun. A feed (e.g., a 75 ohm coaxial input feed, etc.) with a connector 2824 (e.g., a type F Female connector, etc.) may be used to feed at 300 ohms to the UHF tapered loop antenna element 2804. The connector 2824 may be connected to a coaxial cable (e.g., a 75-ohm RG6 coaxial cable fitted with an F-Type Male connector, etc.), which is then used for transmitting signals received by the antenna assembly 2800 to a television, etc. In this example, the UHF and VHF antenna elements 2804, 2810 may have a natural impedance of about 300 ohms if fed from a balanced line, such as a 300 ohm twin lead. At one time, 300 ohm twin leads were very common. But most TV sets include coaxial connections without any twin lead connections. Accordingly, this example includes a 75 to 300 ohm balun to enable the use of the common 75 ohm coaxial cable. In this example, the balun is performing a conversion from unbalanced to balanced line as well as a 4*x* step up in impedance between the coaxial feed and the antenna. Alternative embodiments may include other connectors, coaxial cables, or other suitable communication links.

A wide range of materials may be used for the antenna assembly 2800 and other antenna assemblies disclosed herein. In an exemplary embodiment, the substrate 2806 comprises 0.4 mm thick polypropylene substrate. Alternatively, other materials may be used for the substrate, such as FR4 composite material, silicone, glass, polyurethane rubber, other polymers, thicker or thinner materials, etc.

The antenna assembly 2800 may also include an outer surface or cover that may be positioned overtop or on the substrate 2806 to thereby cover the UHF and VHF antenna elements 2804, 2810. The UHF and VHF antenna elements 2804, 2810 may be completely enclosed within an interior defined between the substrate 2806 and the cover. In an exemplary embodiment, the cover comprises 0.4 mm thick polypropylene cover. In some exemplary embodiments, the cover may be optically transparent or translucent such that the UHF and VHF antenna elements 2804, 2810 underlying the cover may be visible through the cover. The cover may comprise a naturally tacky or self-adherent material. With the naturally tacky or self-adherent properties, the cover may allow the antenna assembly 2800 to be mounted or attached directly to a window or other support surface without any additional adhesives needed between the window and the naturally tacky or self-adherent cover or outer covering of the antenna assembly 2800. Advantageously, mounting an antenna assembly to a window may provide a higher and more consistent HDTV signal strength as compared to interior locations of a home. An antenna assembly may be mounted on various window types, such as a single or double pane window that is partially frosted and does not include a low e-coating, etc. Alternatively, other materials may be used for the cover, such as other polymers, thicker or thinner materials, non-tacky materials, glass, polycarbonate, etc. In addition, the antenna assembly 2800 may also be integrated into a picture/photo frame. See, for example, FIGS. 34 through 37 illustrating an exemplary embodiment in which the UHF and VHF antenna elements 2804, 2810 are enclosed within or integrated into a picture/photo frame.

The UHF and VHF antenna elements 2804, 2810 may comprise an electrically-conductive material (e.g., aluminum or copper foil, anodized aluminum, copper, stainless steel, other metals, other metal alloys, etc.). By way of example, the UHF and VHF antenna elements 2804, 2810 may be flat with a generally constant or uniform thickness and/or be stamped from metal (e.g., copper sheet metal, etc.). The UHF and VHF antenna elements 2804, 2810 may be etched on a PCB coated in copper or other suitable material (e.g., coated in one ounce of copper per square foot (equivalent to approximately 35 um thickness), etc.). Alternative embodiments may include a substrate and/or elements configured differently, e.g., that are curved, do not have a generally constant or uniform thickness, and/or formed from a different material and/or process besides stamped metal, etc. For example, the substrate 2106 may comprise a flexible polymer substrate, and the antenna element 2104, the first and second arms 2110, 2114, and the first and second members 2118, 2122 may comprise one or more thin flexible antenna elements made of thin electrically-conductive metal foils bonded to the substrate with adhesive or electrically-conductive material sputtered on the flexible polymer substrate. As another example, the antenna element 2104, the first and second arms 2110, 2114, and the first and second members 2118, 2122 may comprise a single piece of electrically-conductive material (e.g., copper, etc.) having a monolithic construction. As a further example, the substrate 2106 may comprise a polyester substrate, and the antenna element 2104, the first and second arms 2110, 2114, and the first and second members 2118, 2122 may comprise electrically-conductive ink screen printed on the polyester substrate.

The back or rear surface(s) of the antenna assembly 2100 may be flat and planar. This, in turn, would allow the flat back surface to be positioned flush against a window. Accordingly, some exemplary embodiments of an antenna assembly do not include or necessarily need a support or mount having a base or stand for supporting or mounting the antenna assembly to a horizontal surface, to a vertical surface, or to a reflector and mounting post. In other exemplary embodiments, the antenna assembly 2100 may include a reflector and/or support having a base or stand. For example, the antenna assembly 2100 may include a dielectric center support.

In some exemplary embodiments, the substrate 2106, antenna element 2104, first and second arms 2110, 2114, and first and second members 2118, 2122 may have sufficient flexibility to be rolled up into a cylindrical or tubular shape and then placed into a tube, etc., to reduce shipping costs and decrease shelf space requirements, etc. In an exemplary embodiment, the antenna element 2104, first and second arms 2110, 2114, and first and second members 2118, 2122 may be adhered to a sticky silicone mat or substrate, which, in turn, could adhere to glass. In an exemplary embodiment, the substrate 2106 may comprise a flexible polymer substrate, and the antenna element 2104, the first and second arms 2110, 2114, and the first and second members 2118, 2122 may comprise one or more thin flexible antenna elements made of electrically-conductive material (e.g., metals, silver, gold, aluminum, copper, etc.) sputtered on the flexible polymer substrate. In another exemplary embodiment, the antenna element 2104, the first and second arms 2110, 2114, and the first and second members 2118, 2122 may comprise a single piece of electrically-conductive material (e.g., metals, silver, gold, aluminum, copper, etc.) having a monolithic construction. In still a further exemplary embodiment, the substrate 2106 may comprise a polyester substrate, and the antenna element 2104, the first and second arms 2110, 2114, and the first and second members 2118, 2122 may comprise electrically-conductive ink (e.g., silver, etc.) screen printed on the polyester substrate.

FIG. 25 illustrate an exemplary embodiment of an HDTV antenna assembly 2900 embodying one or more aspects of the present disclosure. As shown, the antenna assembly 2900 includes the UHF antenna element 2804 and VHF antenna element 2810 shown in FIGS. 16 and 17 and described above. The UHF and VHF antenna elements 2804, 2810 are completely enclosed within a housing or radome 2930.

The antenna assembly 2900 further includes a mounting pole 2932 coupled to the radome 2930. By way of example, the mounting pole 2932 may be mechanically fastened to a back of the radome 2930 as shown in FIG. 28. The mounting pole 2932 and radome 2930 are also shown in FIGS. 27 through 32. To help minimize detuning of the antenna, the mounting fasteners are placed near to and just behind the center of the UHF element 2804 by about 25 mm to 35 mm. The mounting pole 2932 is aligned vertically along the vertical center line or mirror plane of the VHF and UHF elements 2810, 2804. The radome 2930 may be waterproof and weatherproof to thereby protect the antenna components within the radome 2930. Accordingly, this exemplary embodiment of the antenna assembly 2900 may thus be configured for outdoor use (e.g., mountable on a roof, etc.).

A balun 2912 is coupled to the UHF antenna element 2804 at an end of the open slot of the UHF antenna element 2804. By way of example only, the balun 2912 may comprise a 75 to 300 Ohm balun. A feed (e.g., a 75 ohm coaxial input feed, etc.) with a connector 2924 (e.g., a type F Female connector, etc.) may be used to feed at 300 ohms to the UHF tapered loop antenna element 2804. The connector 2924 may be connected to a coaxial cable (e.g., a 75-ohm RG6 coaxial cable fitted with an F-Type Male connector, etc.), which is then used for transmitting signals received by the antenna assembly 2900 to a television, etc. Alternative embodiments may include other connectors, coaxial cables, or other suitable communication links.

A wide range of materials may be used for the antenna assembly 2900 and other antenna assemblies disclosed herein. In an exemplary embodiment, the radome 2930 comprises plastic (e.g., Acrylonitrile Butadiene Styrene (ABS), etc.). In some exemplary embodiments, the radome 2930 or portion thereof may be optically transparent or translucent such that the UHF and VHF antenna elements 2804, 2810 within the radome 2930 may be visible through the radome 2930. Alternatively, other materials may be used for the radome, such as other plastics, polycarbonate, and other dielectric materials, etc.

FIGS. 34 through 37 illustrate an exemplary embodiment of an HDTV antenna assembly 3000 embodying one or more aspects of the present disclosure. As shown in FIGS. 34 and 36, the antenna assembly 3000 includes the UHF antenna element 2804 and VHF antenna element 2810 shown in FIGS. 16 and 17 and described above. The UHF and VHF antenna elements 2804, 2810 are enclosed within or integrated into a picture or photo frame. The frame includes a substrate, backing or backplane 3006 and a perimeter frame member 3078 disposed around the perimeter of the backplane 3006, as shown in FIG. 35.

The antenna assembly 3000 includes a balun 3012 along the backing or backplane 3006 of the frame. The balun 3012 is coupled to the UHF antenna element 2804 at an end of the open slot of the UHF antenna element 2804. By way of example only, the balun 3012 may comprise a 75 to 300 Ohm balun. A feed (e.g., a 75 ohm coaxial input feed, etc.) with a connector 3024 (e.g., a type F Female connector, etc.) may be used to feed at 300 ohms to the UHF tapered loop antenna element 2804. The connector may be connected to a coaxial cable (e.g., a 75-ohm RG6 coaxial cable fitted with an F-Type Male connector, etc.), which is then used for transmitting signals received by the antenna assembly 3000 to a television, etc. Alternative embodiments may include other connectors, coaxial cables, or other suitable communication links.

As shown in FIGS. 36 and 37, a hanger 3080 may be provided along the backing or backplane 3006. In this exemplary embodiment, the hanger 3080 is a keyhole frame hanger. Alternative embodiments may include a different hanger or no hanger at all.

Exemplary embodiments of the present disclosure include antenna assemblies that may be scalable to any number of (one or more) antenna elements depending, for example, on the particular end-use, signals to be received or transmitted by the antenna assembly, and/or desired operating range for the antenna assembly. By way of example only, another exemplary embodiment of an antenna assembly is double sided (e.g., for extra bandwidth, etc.) such that the antenna elements (e.g., 2102 in FIG. 1, etc.) including the antenna element (e.g., 2204, etc.), the first and second arms (e.g., 2110 and 2114, etc.), and the first and second members (e.g., 2118 and 2122, etc.), are duplicated on opposite first and second sides of the substrate (e.g., 2106, etc.). Alternative embodiments may include a high definition television antenna assembly that is single sided such that the antenna element (e.g., 2104, etc.), the first and second arms (e.g., 2110 and 2114, etc.), and the first and second members (e.g., 2118 and 2122, etc.), are along only one side of the substrate (e.g., 2106, etc.).

An antenna assembly (e.g., 2100, 2200, 2300, 2400, 2500, 2600, 2800, 2900, etc.) disclosed herein may be operable for receiving VHF and UHF high definition television signals (e.g., a VHF frequency range of about 174 MHz to about 216 MHz, a UHF frequency range from about 470 MHz to about 698 MHz, etc.). The antenna assembly may include a plurality of elements (e.g., 2102, 2202, 2302, 2402, 2502, 2602, 2702, 2802, etc.) on a substrate (e.g., 2106, 2206, 2306, 2406, 2506, 2606, 2806, etc.). The plurality of elements may include an antenna element (e.g., 2104, 2204, 2304, 2404, 2504, 2604, 2704, 2804, etc.) having a generally annular shape with an opening (e.g., 2148, 2248, 2348, 2448, 2548, 2648, 2848, etc.) and spaced-apart first and second portions (e.g., 2128, 2228, 2328, 2428, 2528, 2628, 2828, etc.) The antenna element may comprise a tapered loop antenna element having a middle portion (e.g., 2126, 2826, etc.), first and second curved portions (e.g., 2150, 2152, 2850, 2852, etc.) extending from the respective first and second end portions to the middle portion such that the antenna element's annular shape and opening are generally circular. The first and second curved portions may gradually increase in width from the respective first and second end portions to the middle portion such that the middle portion is wider than the first and second end portions and such that an outer diameter of the antenna element is offset from a diameter of the generally circular opening. The first curved portion may be a mirror image of the second curved portion. A center of the generally circular opening may be offset from a center of the generally circular annular shape of the antenna element. The tapered loop antenna element may be flat with a generally constant or uniform thickness and/or stamped from metal (e.g., copper sheet metal, etc.).

In addition, the plurality of elements may further include first and second arms (broadly, antenna elements) (e.g., 2110 and 2114, etc.) spaced apart from the antenna element (e.g., tapered loop or generally annular element, etc.). The first and second arms may extend at least partially along portions (e.g., a bottom portion and respective first and second side portions, etc.) of the antenna element. The plurality of elements may also include first and second connectors, connecting portions, or members (e.g., 2118, 2122, etc.). The first member may extend between and connect the first arm and the first end portion of the antenna element. The second member may extend between and connect the second arm and the second end portion of the antenna element. A substrate (e.g., 2106, 2206, 2306, 2406, 2506, 2606, 2806 etc.) may support and/or be coupled to the antenna element and the first and second arms. The substrate, the antenna element, and the first and second arms may be capable of being bent, flexed, or curved to have a radius of curvature of 300 millimeters or less. The antenna element and the first and second arms may cooperatively define a generally menorah shape (e.g., an upper portion of a menorah without the base, etc.).

Exemplary embodiments of an antenna assembly disclosed herein may be configured to provide one or more of the following advantages. For example, embodiments disclosed herein may provide antenna assemblies that have better VHF gain (e.g., up to 4.8 decibels (dB), etc.) and UHF gain (e.g., up to 2.5 dB, etc.) better than other existing HDTV antenna assemblies. Also, by way of example, exemplary embodiments of an antenna assembly disclosed herein may be used or included within an HDTV flat panel antenna that is operable with both VHF and UHF high definition television signals and that have better performance (e.g., the best or better VSWR curve, etc.) than other existing HDTV flat panel antennas of similar physical size. By way of further example, exemplary embodiments of an antenna assembly disclosed herein may be configured to be operable for receiving VHF high definition television signals from about 174 megahertz to about 216 megahertz with a voltage standing wave ratio of less than 3 (referenced to a 75 ohm line) and realized gain within a range from about 0.5 dBi to about 1.5 dBi, and for receiving UHF high definition television signals from about 470 megahertz to about 698 megahertz with a voltage standing wave ratio of less than 2 (referenced to a 75 ohm line) and realized gain within a range from about 3.8 dBi to about 5.4 dBi.

Exemplary embodiments of antenna assemblies (e.g., 2100, 2200, 2300, 2400, 2500, 2600, 2800, 2900, 3000, etc.) have been disclosed herein as being used for reception of digital television signals, such as HDTV signals. Alternative embodiments, however, may include antenna elements tuned for receiving non-television signals and/or signals having frequencies not associated with HDTV. Thus, embodiments of the present disclosure should not be limited to receiving only television signals having a frequency or within a frequency range associated with digital television or HDTV. Therefore, the scope of the present disclosure should not be limited to use with only televisions and signals associated with television.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A high definition television antenna assembly configured to be operable for receiving VHF high definition television signals and UHF high definition television signals, the high definition television antenna assembly comprising:

a first antenna element having a generally annular shape with an opening and first and second end portions; and a second antenna element including first and second arms spaced apart from the first antenna element and extending at least partially along portions of the first antenna element;

wherein the first and second antenna elements are substantially coplanar; and wherein each of the first and second arms includes a bottom portion, an upwardly extending portion generally perpendicular to the bottom portion, a rounded end portion between the upwardly extending portion and a concave portion that extends from the rounded end portion generally under the first antenna element.

2. The high definition television antenna assembly of claim 1, further comprising a substrate, and wherein the first and second antenna elements are along a same side of the substrate.

3. The high definition television antenna assembly of claim 2, wherein:

the substrate is a flat or planar substrate; and the first and second antenna elements are along a same side of the flat or planar substrate such that the first and second antenna elements are coplanar.

4. The high definition television antenna assembly of claim 1, further comprising a naturally tacky and/or self-adherent material operable for mounting the first and second antenna elements along a same side of a glass window without any additional adhesive needed between the glass window and the high definition television antenna assembly.

5. The high definition television antenna assembly of claim 1, wherein the first and second antenna elements are electromagnetically coupled without a direct ohmic connection between the first and second antenna elements.

6. The high definition television antenna assembly of claim 1, further comprising a substrate, and wherein:

the first and second antenna elements are along a same side of the substrate such that the first and second antenna elements are coplanar; and the first and second antenna elements are electromagnetically coupled without a direct ohmic connection between the first and second antenna elements.

7. The high definition television antenna assembly of claim 1, wherein:

the first and second antenna elements cooperatively define a generally menorah shape configured to be operable for receiving VHF and UHF high definition television signals; and/or the first and second antenna elements cooperatively define a generally menorah shape in which the first antenna element represents a center starter candle and the first and second arms respectively represent our outer candles along each side of the center starter candle; and/or the high definition television antenna assembly is configured to be operable for receiving VHF high definition television signals from about 174 megahertz to about 216 megahertz with a voltage standing wave ratio of less than 3 (referenced to a 300 ohm line) and for receiving UHF high definition television signals from about 470 megahertz to about 698 megahertz with a voltage standing wave ratio of less than 2 (referenced to a 300 ohm line).

8. The high definition television antenna assembly of claim 1, further comprising a balun coupled to the first antenna element at an end of an open slot defined between the first and second end portions of the first antenna element.

9. The high definition television antenna assembly of claim 8, wherein:

the balun is a 75 to 300 Ohm balun;

the high definition television antenna assembly further comprises a 75 ohm coaxial input feed with a type F Female connector for feeding the first antenna element at 75 ohms; and the type F Female connector is downward facing whereby the high definition television antenna assembly is positionable flush against a window.

10. The high definition television antenna assembly of claim 1, wherein the first antenna element comprising a tapered loop antenna element including generally circular inner and outer perimeter portions such that the annular shape of the first antenna element and opening are generally circular.

11. The antenna assembly of claim 1, wherein the second antenna element comprises a single piece element having a monolithic construction without any slot separating the first and second arms of the second antenna element.

12. The antenna assembly of claim 1, wherein:

the first and second arms are generally symmetric; and the first arm is a mirror-image of the second arm.

13. A high definition television antenna assembly configured to be operable for receiving VHF high definition television signals and UHF high definition television signals, the high definition television antenna assembly comprising:

a first antenna element having a generally annular shape with an opening and first and second end portions; and a second antenna element including first and second arms spaced apart from the first antenna element and extending at least partially along portions of the first antenna element;

wherein:

the first and second antenna elements are substantially coplanar;

the first and second arms are generally symmetric;

the first arm is a mirror-image of the second arm; and each of the first and second arms includes a linear bottom portion, an upwardly extending linear portion generally perpendicular to the linear bottom portion, a rounded end portion between the upwardly extending linear portion and a concave portion that extends from the rounded end portion generally under the first antenna element.

14. A high definition television antenna assembly configured to be operable for receiving VHF high definition television signals and UHF high definition television signals, the high definition television antenna assembly comprising:

a first antenna element having a generally annular shape with an opening and first and second end portions;

a second antenna element including first and second arms spaced apart from the first antenna element and extending at least partially along portions of the first antenna element; and a substrate, wherein the first and second antenna elements are along a same side of the substrate;

wherein each of the first and second arms includes a bottom portion, an upwardly extending portion generally perpendicular to the bottom portion, a rounded end portion between the upwardly extending portion and a concave portion that extends from the rounded end portion generally under the first antenna element.

15. The high definition television antenna assembly of claim 14, wherein:

the substrate is a flat or planar substrate; and the first and second antenna elements are along a same side of the flat or planar substrate such that the first and second antenna elements are substantially coplanar.

16. The high definition television antenna assembly of claim 14, wherein the first and second antenna elements are electromagnetically coupled without a direct ohmic connection between the first and second antenna elements.

17. The high definition television antenna assembly of claim 14, wherein the substrate comprises a naturally tacky and/or self-adherent material operable for mounting the first and second antenna elements along a same side of a glass window without any additional adhesive needed between the glass window and the high definition television antenna assembly.

18. The high definition television antenna assembly of claim 14, wherein the second antenna element comprises a single piece element having a monolithic construction without any slot separating the first and second arms of the second antenna element.

19. The high definition television antenna assembly of claim 14, wherein:

the first and second arms are generally symmetric; and the first arm is a mirror-image of the second arm.

20. An antenna assembly operable for receiving VHF and UHF high definition television signals, the antenna assembly comprising:

a plurality of antenna elements including:

a UHF tapered loop antenna element having a generally annular shape with an opening and first and second end portions; and a VHF antenna element includes first and second arms spaced apart from the UHF tapered loop antenna element and extending at least partially along portions of the UHF tapered loop antenna element;

wherein the UHF tapered loop antenna element and the VHF antenna element are substantially coplanar; and wherein:

the first and second arms are generally symmetric;

the first arm is a mirror-image of the second arm; and each of the first and second arms includes a linear bottom portion, an upwardly extending linear portion generally perpendicular to the linear bottom portion, a rounded end portion between the upwardly extending linear portion and a concave portion that extends from the rounded end portion generally under the UHF tapered loop antenna element.

21. The antenna assembly of claim 20, further comprising a substrate, and wherein the UHF tapered loop antenna element and the VHF antenna element are along a same side of the substrate.

22. The antenna assembly of claim 21, wherein:

the substrate is a flat or planar substrate; and the UHF tapered loop antenna element and the VHF antenna element are along a same side of the flat or planar substrate such that the UHF tapered loop antenna element and the VHF antenna element are coplanar.

23. The antenna assembly of claim 20, further comprising a naturally tacky and/or self-adherent material operable for mounting the UHF tapered loop antenna element and the VHF antenna element along a same side of a glass window without any additional adhesive needed between the glass window and the antenna assembly.

24. The antenna assembly of claim 20, wherein the UHF tapered loop antenna element and the VHF antenna element are electromagnetically coupled without a direct ohmic connection between the UHF tapered loop antenna element and the VHF antenna element.

25. The antenna assembly of claim 20, wherein:

the plurality of antenna elements cooperatively define a generally menorah shape configured to be operable for receiving VHF and UHF high definition television signals; and/or the plurality of antenna elements cooperatively define a generally menorah shape in which the UHF tapered loop antenna element represents a center starter candle and the first and second arms respectively represent four outer candles along each side of the center starter candle.

26. The antenna assembly of claim 20, further comprising:

a balun coupled to the UHF tapered loop antenna element at an end of an open slot defined between the first and second end portions of the UHF tapered loop antenna element; and a coaxial input feed with a connector for feeding the UHF tapered loop antenna element, wherein the connector is downward facing whereby the antenna assembly is positionable flush against a window.

* * * * *